US006761853B2

(12) United States Patent
Ishida et al.

(10) Patent No.: US 6,761,853 B2
(45) Date of Patent: Jul. 13, 2004

(54) FREE-CUTTING TOOL STEEL

(75) Inventors: Kiyohito Ishida, 5-20, Kamisugi 3-chome, Aoba-ku, Sendai-shi, Miyagi (JP); Katsunari Oikawa, 4-1-34, Nishifunabasama, Shibata-cho, Shibata-gun, Miyagi (JP); Toshimitsu Fujii, Nagoya (JP); Yukinori Matsuda, Nagoya (JP); Kozo Ozaki, Nagoya (JP); Seiji Kurata, Nagoya (JP); Takayuki Shimizu, Nagoya (JP)

(73) Assignees: Kiyohito Ishida, Miyagi (JP); Katsunari Oikawa, Miyagi (JP); Dokuritsu Gyousei Houjin Sangyo Gijutsu Sougo Kenkyusho, Tokyo (JP); Daido Tokushuko Kabushiki Kaisha, Aichi (JP)

( * ) Notice: Subject to any disclaimer, the term of this patent is extended or adjusted under 35 U.S.C. 154(b) by 0 days.

(21) Appl. No.: 10/084,495

(22) Filed: Feb. 28, 2002

(65) Prior Publication Data

US 2003/0066577 A1 Apr. 10, 2003

(30) Foreign Application Priority Data

Mar. 5, 2001 (JP) ..... 2001-060782
Mar. 5, 2001 (JP) ..... 2001-060809
Sep. 13, 2001 (JP) ..... 2001-278579

(51) Int. Cl.[7] ..... C22C 38/60; C22C 38/14; C22C 38/50

(52) U.S. Cl. ..... 420/41; 420/42; 420/84; 420/87

(58) Field of Search ..... 420/41, 42, 84, 420/87

(56) References Cited

U.S. PATENT DOCUMENTS 4,705,581 A * 11/1987 Honkura et al. ..... 420/41
5,013,524 A * 5/1991 Leban ..... 420/87
5,190,722 A * 3/1993 Saito et al. ..... 420/41
5,922,145 A * 7/1999 Watari et al. ..... 420/41

FOREIGN PATENT DOCUMENTS

JP 8260107 * 10/1996 ..... C22C/38/00
JP 9296221 * 11/1997 ..... C21D/9/46

OTHER PUBLICATIONS

Japanese Patent No. JP7188864, dated Jul. 25, 1995, and Abstract thereof.
Japanese Laid–open Patent Publication No. 60–67641 dated Apr. 18, 1985 And Abstract Thereof.

* cited by examiner

*Primary Examiner*—Deborah Yee
(74) *Attorney, Agent, or Firm*—Townsend & Banta

(57) ABSTRACT

A free-cutting tool steel is provided containing Fe and C in an amount of 0.1 to 2.5 wt %, Ti and or Zr where $W_{Ti}$+ $0.52W_{Zr}$ constitutes 0.03 to 3.5 wt %, and $W_{Ti}$ represents Ti content and $W_{Zr}$ represents Zr content, at least any one of S, Se and Te where $W_S+0.4W_{Se}+0.25W_{Te}$ constitutes 0.01 to 1.0 wt %, and $(W_{Ti}+0.52W_{Zr})/(W_S+0.4W_{Se}+0.25W_{Te})$ constitutes 1 to 4, and $W_S$ represents S content, $W_{Se}$ represents Se content and $W_{Te}$ represents Te content; and dispersed therein a texture thereof from 0.1 to 10% in terms of area ratio in a section of a machinability improving compound phase of a metallic element component of Ti and/or Zr as major components, and a binding component for the metallic element component containing C and any one of S, Se and Te.

33 Claims, 2 Drawing Sheets

Invented steel No. 6

Invented steel No. 6

Comparative steel No. 4

FREE-CUTTING TOOL STEEL

RELATED APPLICATIONS

This application claims the priority of Japanese Patent Applications No. 2001-060782 filed on Mar. 5, 2001, No. 2001-060809 filed on Mar. 5, 2001 and No. 2001-278579 filed on Sep. 13, 2001, which are incorporated herein by reference.

BACKGROUND OF THE INVENTION

1. Field of the Invention

The present invention relates to a tool steel used as source materials for tools and dies, and in particular to a tool steel having machinability.

2. Related Art

It is a general practice for dies and tools that they are fabricated first using an annealed steel material, then subjected to roughing, quench-and-temper for adjusting hardness, and finishing. In some cases, the tools and dies are fabricated using an already quenched-and-tempered steel material and then directly finished aiming at shorter period before delivery date. This relates to process sharing in order to fabricate the dies and tools between the material supplier and the user fabricating such dies and tools. That is, the material supplier supplies the user with an annealed steel material in the former case, so that the user is responsible for roughing, quench-and-temper and finishing. On the other hand, the steel material is supplied in a quenched and tempered form in the latter case, so that the user is responsible only for the final processing. The final processing herein requires a somewhat larger amount of processing since no roughing has been effected.

In either case, the processing is mainly aimed at removal operation such as cutting and grinding. Processing of tool steel is however not so easy as compared with other steel materials, since the tool steel necessarily has hardness and toughness to a level enough to overwhelm the material to be processed. The processing will be more difficult after quench-and-temper. There is a growing demand for shorter period before the delivery and an expanded range of unmanned processing of the die in order to reduce production costs of such dies and tools, so that, to cope with such situation, a tool steel having a better machinability than the previous materials have has been desired.

Known elements for improving the machinability of iron-base materials include S, Pb, Se, Bi, Te and Ca. Recent trends in environmental preservation in a global scale have been repelling use of Pb, and there is a growing number of instruments and parts limiting the use thereof. So that there are proposed substitutive materials using S and Te as major elements for improving the machinability. Such materials are successful in improving the machinability and grinding property since inclusions such as MnS and MnTe generated therein can exhibit stress concentration effect during chip formation, and lubricating effect between the tool and chip.

A problem however resides in the steel materials using S and Te as elements for improving the machinability that such materials tend to be elongated along the direction of rolling or forging to thereby cause undesirable anisotropy in the mechanical properties thereof, although the inclusions such as MnS and MnTe can improve the machinability. More specifically, the crack resistance will be ruined due to degradation of the toughness in the direction normal to the direction of forging and rolling (referred to as T-direction, hereinafter). This raises another problem that it will always be necessary to consider material orientation depending on mode of use of the tools and dies, which tends to result in degrading production efficiency and yield ratio from a viewpoint of effective use of the material.

It is also undesirable that the inclusions are generally as long as exceeding 50 $\mu$m. Such large inclusions will undesirably roughen the polished surface of the material during mirror polishing if they drop to thereby scratch the polished surface, or to thereby form large pits where they were embedded, which makes it difficult to obtain a desired level of smoothness of the mirror-polished surface. The large inclusion of the sulfide-base is even causative of degraded corrosion resistance of the material. This is apparent for example from Japanese Laid-Open Patent Publication No. 7-188864 which discloses that the corrosion resistance can be improved by controlling the length of such sulfide-base inclusion so that 80% of which have a length of 50 $\mu$m or less.

SUMMARY OF THE INVENTION

It is therefore an object of the present invention to provide a free-cutting steel which has an excellent machinability, and is less causative of anisotropy in mechanical properties, particularly in toughness, depending on forging-and-rolling direction.

To solve the foregoing problems, a first aspect of a free-cutting tool steel of the present invention contains Fe as a major component and C in an amount of 0.1 to 2.5 wt %;

containing Ti and/or Zr so that $W_{Ti}+0.52W_{Zr}$ amounts to 0.03 to 3.5 wt %, where $W_{Ti}$ represents Ti content (wt %) and $W_{Zr}$ represents Zr content (wt %);

contains at least any one of S, Se and Te so that $W_S+0.4W_{Se}+0.25W_{Te}$ amounts to 0.01 to 1.0 wt %, and so that $(W_{Ti}+0.52W_{Zr})/(W_S+0.4W_{Se}+0.25W_{Te})$ amounts to 1 to 4, where $W_S$ represents S content (wt %), $W_{Se}$ represents Se content (wt %) and $W_{Te}$ represents Te content (wt %); and has dispersed in a texture thereof a machinability improving compound phase within a range from 0.1 to 10% in terms of area ratio in a section; wherein such machinability improving compound phase comprises a metallic element component having Ti and/or Zr as major components, and a binding component for such metallic element component essentially containing C and also containing any one of S, Se and Te. It is to be noted that "major component" in the context of this specification means a component (also including "phase" in conception) having a highest content on the weight basis in a material or texture in consideration (the same will apply to other expressions such as "mainly comprises").

By adding C, Ti, Zr, S, Se and Te in the foregoing compositional ranges, the machinability improving compound phase is produced in a dispersed manner in the texture of the steel material, which compound phase comprising a metallic element component having Ti and/or Zr as major components, and a binding component for such metallic element component essentially containing C and also containing any one of S, Se and Te. The formation of such compound can successfully add an excellent machinability to the steel material. The present inventors suppose that, when the material is processed by cutting or grinding in order to remove a portion thereof, the machinability improving compound phase finely dispersed in the texture functions just like a perforation to thereby facilitate formation of the sectional plane, which is responsible for improved machinability.

An essential point is that the machinability improving compound phase does not elongate in the forging-and-rolling direction even after such processing and can keep the grain form. So that the compound phase is successful in considerably suppressing the degradation of toughness in the T direction, unlike MnS or so which tends to elongate along the forging-and-rolling direction. The free-cutting tool steel of the present invention is excellent in the machinability not only in the annealed state but also in the quenched-and-tempered state, and thus can desirably cope with the repetitive processing in the quenched and tempered state which is beneficial in reducing the period before the delivery.

The machinability improving compound phase is necessarily formed so as to be dispersed in the texture within a range from 0.1 to 10% in terms of area ratio in a section. The area ratio less than 0.1% results in only a poor improving effect of the machinability, and exceeding 10% results in a degraded toughness. The area ratio is more preferably 0.2 to 4%. In order to raise the improving effect of the machinability, it is preferable to control an average size of the machinability improving compound phase observed in the polished sectional texture (maximum width between two parallel tangential lines which are drawn in some different directions so as to circumscribe the outer contour of the compound grain) within a range from 1 to 5 $\mu$m or around.

The machinability improving compound phase can typically be such that mainly comprising a component phase expressed by a composition formula $M_4Q_2C_2$ (where M represents the metallic element component mainly comprises Ti and/or Zr, and Q represents at least any one of S, Se and Te). Such compound is less causative of elongation along the forging-and-rolling direction, excellent in dispersion property into the texture, and excellent in improving effect of the machinability without causing an extreme anisotropy in the mechanical properties. As for the component M in the compound, Ti is essentially contained while optionally containing Zr, and for the case that V is contained as an alloy component, at least a part of which may compose such M. As for the component Q, either one or two or more of S, Se and Te may be contained. Both components M and Q are not precluded from containing any other components than described in the above as subsidiary components in order to obtain the effect of the present invention as far as anti-elongation property and dispersion property which should be owned by the machinability improving compound phase are not ruined.

The $M_4Q_2C_2$-base compound in the steel (may occasionally abbreviated as "TICS" in this specification) can be identified by X-ray diffractometry and electron probe X-ray micro-analysis (EPMA). For example, presence or absence of the $M_4Q_2C_2$-base compound can be confirmed based on presence or absence of the correspondent peak ascribable to such compound in a measured profile obtained by the X-ray diffractometry. An area where the compound is formed in the texture can be specified by subjecting the sectional texture of the steel material to surface analysis based on EPMA, and then comparing two-dimensional mapping results of characteristic X-ray intensity ascribable to Ti, Zr, S, Se or C.

Next paragraphs will describe causes for specifying ranges of contents of the individual components in the tool steel according to a first aspect of the present invention.

The free-cutting tool steel of the present invention contains the foregoing components essential for tool steel since it is basically aimed at exhibiting functions suitable for tool steel. Fe is an essential component for composing the steel, so that it is contained as a major component. C is an essential element for ensuring wear-resistance for the tool steel, and also an essential element for composing the machinability improving compound phase in the present invention. The content of C less than 0.1 wt % will be unsuccessful in achieving hardness and wear-resistance sufficient for the tool steel. On the contrary, excessive addition thereof will degrade hot forming strength, so that the upper limit thereof will be set to 2.5 wt %.

Ti and Zr are essential component element of the machinability improving compound phase which plays a principal role in exhibiting improving effect of the machinability of the free-cutting tool steel of the present invention. A value of $W_{Ti}+0.52W_{Zr}$ less than 0.03 wt % will result in an insufficient amount of production of the machinability improving compound phase, so that a sufficient improving effect of the machinability cannot be expected. On the contrary, an excessive value of $W_{Ti}+0.52W_{Zr}$ will lower the machinability, so that the upper limit thereof is set to 3.5 wt %.

It has been known almost empirically that the foregoing machinability improving compound phase such as $M_4Q_2C_2$-base compound phase has an almost constant stoichiometric bonding ratio of bonded component Q or C in respect to the metal component M, and that the machinability is essentially governed by the ratio of formation area of such compound. So that it is often more convenient to describe content of M and Q as indices for estimating the amount of phase formation in an atomic basis rather than weight basis. In this specification, the component M is expressed in a relative atomic content on the basis of Ti, that is, in a form of an optimum content range expressing values equivalent to the weight of the same number of Ti atoms. On the other hand, the component Q described later is expressed in a relative atomic content on the basis of S, that is, in a form of an optimum content range expressing values equivalent to the weight of the same number of S atoms. It is for this purpose that $W_{Zr}$ for expressing the component M is multiplied by a coefficient of 0.52. For the case that other subsidiary components are contained, it is preferable that a sum of weight-base contents obtained by multiplying with proper coefficients for converting into the weight of the same number of Ti atoms amounts to 0.03 to 3.5 wt %.

Similarly, also S, Se and Te (component Q) are essential component elements for the machinability improving compound phase. A value of $W_S+0.4W_{Se}+0.25W_{Te}$ less than 0.01 wt % will result in an insufficient amount of production of the machinability improving compound phase, so that a sufficient improving effect of the machinability cannot be expected. On the contrary, an excessive value of $W_S+0.4W_{Se}+0.25W_{Te}$ will lower the toughness, so that the upper limit thereof is set to 1.0 wt %. Also for the component Q, it is preferable that a sum of weight-base contents obtained by multiplying with proper coefficients for converting into the weight of the same number of S atoms amounts to 0.01 to 1.0 wt %.

For the case the foregoing $M_4Q_2C_2$ is mainly formed as the machinability improving compound phase, a weight ratio of M and Q, assuming M is entirely composed of Ti and Q is entirely composed of S, is 3:1. So that it is ideal to add M and Q in a just manner, that is, to set a value of Ti/S $(W_{Ti}+0.52W_{Zr})/(W_S+0.4W_{Se}+0.25W_{Te})$ to 3. It is to be noted that the effect of the present invention in which the machinability is improved without causing excessive anisotropy in the toughness is obtained not only in a case that the above value is 3, but also in cases that the above value is within a range from 1 to 4.

The free-cutting tool steel of the present invention may further contain any one element selected from Mn in an amount of 2.0 wt % or less, Ni in an amount of 2.5 wt % or less, Cr in an amount of 17 wt % or less, Mo and/or W so that Mo+0.5W amounts to 12 wt % or less, V in an amount of 6 wt % or less, and Co in an amount of 15 wt % or less. Next paragraphs will describe reasons therefor.

Mn: This element has improving effects of hardenability and hardness. The element is valuable if added particularly for the case the machinability is of a great importance, since it can form compounds together with co-existent S and Se responsible for an excellent machinability. More distinct effect will be obtained in a content of 0.1 wt % or above. Formation of excessive MnS on the other hand will cause excessive anisotropy in the toughness, so that the upper limit will be set at 2 wt %. Mn is also used as a deoxidizing element during the refining, and may inevitably be contained.

Ni: This element has improving effects of hardenability, matrix strength and corrosion resistance. More distinct effect will be obtained in a content of 0.1 wt % or above. The upper limit thereof will be set at 2.5 wt %, since the excessive addition will lower the workability.

Cr: This element has improving effects of matrix strength and corrosion resistance through formation of carbide, and of hardenability. More distinct effect will be obtained in a content of 0.1 wt % or above. The upper limit thereof will be set at 17.0 wt %, since the excessive addition will lower the hardenability and high temperature strength.

Mo, W: These elements have improving effects of matrix strength and corrosion resistance through formation of carbide, and of hardenability. Mo and W are elements having almost equivalent effects, where the atomic weight of W is approx. twice as large as that of Mo, so that the content thereof is expressed as Mo+0.5W (of course, addition of either one element or both elements are allowable). More distinct effect will be obtained when Mo+0.5W amounts to 0.1 wt % or above. The upper limit of Mo+0.5W will be set at 12.0 wt %, since excessive addition of Mo and/or W will increase the amount of carbide production to thereby lower the toughness.

V: This element has improving effects of matrix strength and wear resistance through formation of carbide. Formation of fine carbide grains is also advantageous in downsizing the crystal grains and improving the toughness. More distinct effect will be obtained in a content of 0.1 wt % or above. V can also be a component for forming the foregoing compound $M_4Q_2C_2$. The upper limit thereof will be set at 6.0 wt %, since the excessive addition will lower the toughness.

Co: This element is valuable for improving matrix strength. More distinct effect will be obtained in a content of 0.3 wt % or above. The upper limit thereof will be set at 1.5 wt %, since the excessive addition will lower the hot workability and increase the costs for the source material.

The elements enumerated below with allowable upper limits thereof may intentionally be added or may inevitably be included for reasons in the manufacture.

Si: This element is used as a deoxidizing element and is inevitably included for most cases. Intentional addition thereof will improve softening resistance, which is beneficial when the tool steel is used for hot forming dies and machining tools since softening suppressing effect can be expected at an elevated temperature. Some cases however prefer the Si content lowered as possible since the lower Si content can improve the toughness. Deoxidization in such case can be attained by other elements such as Al, Mn and Ca. The upper limit thereof will be set at 2.0 wt % in consideration of lowered toughness due to increased Si content.

Al: This element is used as a deoxidizing element and is inevitably included for most cases. Intentional addition thereof will be effective in downsizing the crystal grain through formation of AlN, and improving the strength and toughness. The upper limit thereof will be set at 0.1 wt %, since the excessive addition will lower the toughness.

N: This element is inevitably included for a structural reason of the steel. The element is intentionally added in some cases, since it can form nitrides together with Ti, Al, V and so forth, which is beneficial in downsizing the crystal grain. The upper limit thereof will be set at 0.040 wt %, since the excessive addition will result in production of a large amount of TiN and thus in a decreased amount of formation of the machinability improving compound phase such as the $M_4Q_2C_2$ phase.

The free-cutting tool steel of the present invention can optionally include the elements enumerated below as occasion demands.

Ca: ≦0.05 wt %

This element is valuable in improving the hot workability. It is also beneficial in improving the machinability through formation of sulfide and oxide. The upper limit of the content will be set to 0.050 wt %, since the excessive addition will be no more effective due to saturation of such effect.

Pb: ≦0.2 wt %, Bi: ≦0.2 wt %

These elements can disperse in the steel to thereby improve the machinability. The upper limits thereof will be set to 0.2 wt %, since the excessive addition will lower the hot workability. More distinct effects will be obtained in a content of 0.02 wt % or above for both elements.

B: ≦0.010 wt %

This element is valuable in improving the hardenability. The upper limit of the content will be set to 0.010 wt %, since the excessive addition will lower the hot workability and toughness. More distinct effects will be obtained in a content of 0.001 wt % or above.

Nb (wt %)+0.5Ta (wt %): ≦0.05 wt %

Both elements can form fine carbides, and are beneficial in downsizing the crystal grain and improving the toughness. The content is specified with an expression of Nb+0.5Ta since the atomic weight of Ta is approx. twice as large as that of Nb (where, addition of either one element or both elements are allowable). The upper limit of Nb+0.5Ta will be set to 0.05 wt %, since the excessive addition will be no more effective due to saturation of such effect. More distinct effect will be obtained when Nb+0.5Ta amounts to 0.005 wt % or above.

Rare Earth Metals (REM): ≦0.50 wt %

These elements are valuable in fixing impurities such as O, P and so forth, raising cleanliness of the matrix, and improving the toughness. The upper limit will be set to 0.50 wt %, since the excessive addition will be causative of cracks in the base. It is to be noted that using mainly rare earth metals having a low radioactivity is preferable for easy handling, and it is effective to use at least one metal selected from Sc, Y, La, Ce, Pr, Nd, Sm, Eu, Gd, Tb, Dy, Ho, Er, Tm, Yb and Lu. In consideration of more distinct effect and cost competitiveness, it is preferable to use light rare earth metals, which are typified as La and Ce. It is of no problem if a trace amount of radioactive rare earth metals (e.g., Th and U), which inevitably remain in the isolation process for rare earth elements, are included. It is also allowable, from the viewpoint of cost reduction of the source material, to use non-separated rare earth metals such as misch metal or didymium.

The free-cutting tool steel of the present invention can be produced by using various known tool steels having conventional compositions as a base material, and forming as being dispersed therein the machinability improving compound phase, to thereby add an excellent machinability without seriously ruining the original properties of the base tool steel. Specific examples of the tool steel of the present invention will be explained below.

(1) A composition containing C in an amount of 0.1 to 0.6 wt %, and containing at least any one element selected from Mn in an amount of 2.0 wt % or less, Ni in an amount of 1.0 wt % or less, Cr in an amount of 3 wt % or less, Mo and/or W so that Mo+0.5W amounts to 1.0 wt % or less, V in an amount of 0.5 wt % or less, and Co in an amount of 1.0 wt % or less. The steel material having such composition is suitable for applications in which requirements for the hardness and heat resistance are not so severe, but easy machinability is of importance for typically producing die for molding plastics where machining for creating a complicated cavity shape is required. Representative base compositions can be exemplified by those specified in JIS S55C and AISI P20.

(2) A composition containing C in an amount of 0.2 to 0.6 wt %, essentially containing Cr in an amount of 0.3 to 7 wt %, and containing at least any one element selected from Mn in an amount of 2.0 wt % or less, Ni in an amount of 2.5 wt % or less, Mo and/or W so that Mo+0.5W amounts to 4.0 wt % or less, V in an amount of 2 wt % or less, and Co in an amount of 5.0 wt % or less. This is equivalent to the composition of above (1) added with a certain amount of Cr to thereby improve the strength in higher temperature range, and the steel material having such composition is suitable for hot forming die (e.g., hot press forming die, hot forging die, die-casting die, hot extrusion molding die). Representative base compositions can be exemplified by those specified in JIS SKD6, SKD8, SKD61 and Cr—Mo steel (e.g., 5 wt % Cr-3 wt % Mo).

(3) A composition containing C in an amount of 0.3 to 1.8 wt %; and containing at least any one element selected from Cr in an amount of 4 wt % or less, Mn in an amount of 2.0 wt % or less, Ni in an amount of 2.5 wt % or less, Mo and/or W so that Mo+0.5W amounts to 2.5 wt % or less, V in an amount of 1 wt % or less, and Co in an amount of 1.0 wt % or less. The steel having such composition is referred to a material attaining a higher level of hardness based on high-carbon-content composition, and is suitable for cold forming die (e.g., cold press forming die, press punch, trimming die and die), cutting tool (e.g., knife, razor and saw blade), and impact-resistant tool (e.g., chisel and punch). Representative base compositions can be exemplified by those specified in JIS SK3, SKS4 and SKS51.

(4) A composition containing C in an amount of 0.5 to 2.5 wt %, essentially containing Cr in an amount of 4 to 17 wt %, and containing at least any one element selected from Mn in an amount of 2.0 wt % or less, Ni in an amount of 1.0 wt % or less, Mo and/or W so that Mo+0.5W amounts to 1.5 wt % or less, V in an amount of 1 wt % or less, and Co in an amount of 1.0 wt % or less. The steel having such composition is referred to a material attaining an improved wear resistance and hardenability based on higher carbon content and addition of Cr, and is suitable for cold forming die (e.g., cold press forming die, press punch, trimming die and die) Representative base compositions can be exemplified by those specified in JIS SKD1, SKD11, SKD12 and Cr tool steel (e.g., 8 wt % Cr).

(5) A composition containing C in an amount of 0.5 to 2.0 wt %, containing at least any three elements selected from Cr as an essential element in an amount of 3 to 7 wt %, Mo and/or W as an essential element so that Mo+0.5W amounts to 4 to 12 wt %, V as an essential element in an amount of 0.5 to 6.0 wt %, Mn in an amount of 2.0 wt % or less, Ni in an amount of 1.0 wt % or less, and Co in an amount of 15.0 wt % or less. The base composition is equivalent to that of high-speed steel. The steel having such composition is suitable for known application fields of high-speed steel, which are exemplified by cutting tool (e.g., drill, end mill, bite and throw away chip), cold forming die (e.g., cold press forming die, press punch, trimming die and die) and hot forming die (e.g., hot press forming die, hot forging die and hot extrusion molding die). Although the high-speed tool steel in the general meaning is such that containing crystallized carbide to thereby ensure the wear resistance and that containing precipitated carbide also in the iron matrix to thereby improve the strength, it is to be noted that a steel material in which crystallization of carbides is suppressed in the entire portion but allowed only in the matrix to thereby improve the strength (so-called matrix high-speed steel) is also recognized as one of such high-speed steel in this specification.

To solve the foregoing problems, a second aspect of a free-cutting tool steel of the present invention contains Fe as a major component and C in an amount of 0.001 to 0.6 wt %; and further contains Ni in an amount of 6 wt % or less, Cu in an amount of 5 wt % or less, and Al in an amount of 3 wt % or less;

wherein such tool steel further contains:

Ti and/or Zr so that X (wt %)=$W_{Ti}$+0.52$W_{Zr}$ amounts to 0.03 to 3.5 wt %, where $W_{Ti}$ represents Ti content (wt %) and $W_{zr}$ represents Zr content (wt %);

at least any one of S, Se and Te so that Y (wt %) $W_S$+0.4$W_{Se}$+0.25$W_{Te}$ amounts to 0.01 to 1 wt %, where $W_S$ represents S content (wt %), $W_{Se}$ represents Se content (wt %) and $W_{Te}$ represents Te content (wt %); and having dispersed in a texture thereof a machinability improving compound phase; wherein such machinability improving compound phase comprises a metallic element component having Ti and/or Zr as major components, and a binding component for such metallic element component essentially containing C and also containing any one of S, Se and Te.

By adding C, Ti, Zr, S, Se and Te in the foregoing compositional ranges, the machinability improving compound phase is produced in a dispersed manner in the texture of the steel material, which compound phase comprising a metallic element component having Ti and/or Zr as major components, and a binding component for such metallic element component essentially containing C and also containing any one of S, Se and Te. The formation of such compound can successfully add an excellent machinability to the steel material, similarly to the free-cutting tool steel according to the first aspect of the present invention.

Similarly to the free-cutting tool steel according to the first aspect of the present invention, the machinability improving compound phase does not elongate in the forging-and-rolling direction even after such processing, and can keep the grain form. So that the compound phase is successful in considerably suppressing the degradation of toughness in the T direction. The free-cutting tool steel according to the second aspect of the present invention is excellent in the machinability not only in the annealed state but also in the quenched-and-tempered state, and thus can desirably cope with the repetitive processing in the quenched-and-tempered state which is beneficial in reducing the period before the delivery.

The free-cutting tool steel according to the second aspect of the present invention contains no machinability improving compound phase having a size exceeding 50 $\mu$m or above, where such size being observed in the polished sectional texture and being expressed by maximum width between two parallel tangential lines which are drawn in some different directions so as to circumscribe the outer contour of the compound grain, so that the tool steel is excellent in the mirror surface smoothness and corrosion resistance. The machinability improving compound phase mainly comprises a compound phase expressed by the foregoing $M_4Q_2C_2$.

When the machinability improving compound phase is provided as $M_4Q_2C_2$ in the free-cutting tool steel according to the second aspect of the present invention, the components are preferably adjusted so that the values X ($=W_{Ti}+0.52W_{Zr}$) and Y ($=W_S+0.4W_{Se}+0.25W_{Te}$) satisfy a relation of $1 \leqq X/Y \leqq 4$. A value of X/Y out of such range may result in insufficient formation of the $M_4Q_2C_2$-type compound, which can provide only a limited range of machinability.

Next paragraphs will describe reasons for specifying the content ranges of various elements contained in the free-cutting tool steel according to the second aspect of the present invention.

(1) A Composition Containing Fe as a Major Component, and Containing C in an Amount of 0.001 to 0.6 wt %:

The free-cutting tool steel of the present invention contains the foregoing components essential for tool steel since it is basically aimed at exhibiting functions suitable for tool steel. Fe is an essential component for composing the steel, so that it is contained as a major component. C is an essential element for ensuring a necessary level of hardness of the tool steel, and is also an essential element in the present invention for composing the machinability improving compound phase for improving the machinability. It is necessary that the content of C is at least 0.001 wt % or above. The upper limit thereof is, however, preferably set since excessive addition of C is causative of formation of carbides which are undesirable for improving the machinability. Since the free-cutting tool steel of the present invention can successfully gain improved hardness and strength by virtue of aging precipitation of (Ni, Al)-base compound described later, so that it is preferable in such case to suppress the C content to a proper level. Excessive addition of C aiming at improved hardness will undesirably degrade the toughness. From this point of view, the C content is preferably limited to 0.6 wt % or less, more preferably within a range from 0.001 to 0.4 wt %, and still more preferably within a range from 0.05 to 0.25 wt %. It is also desirable to properly adjust the C content so that the machinability improving compound phase can be formed in the best condition for attaining improving effect of the machinability. The residual C not included as a component element into the machinability improving compound phase is solubilized in the solid state into the steel texture, to thereby exhibit improving effect of the hardness of the steel.

(2) Ni in an Amount of 6 wt % or Less:

In the tool steel of the present invention, Ni is responsible for preventing red brittleness in the hot working through all-proportional solubilization of a part of which with Cu. For the case the foregoing aging precipitation hardening is carried out, Ni composes together with Cu a phase which will later be a nucleus of the (Ni, Al)-base compound. The (Ni, Al)-base compound is an α'-phase compound typically expressed by a composition formula of NiAl, and aging precipitation of such compound improves the hardness of the tool steel, and also upgrades the strength in high temperature range. Addition of Ni is also beneficial in that improving the corrosion resistance of the tool steel. It is however to be noted that the addition exceeding 6 wt % will be no more effective due to saturation of such effect and may even result in lowered workability and increase in the production cost. On the other hand, Ni is preferably contained in an amount of 1 wt % or above, and more preferably 2.5 wt % in order to fully obtain the effect of the aging precipitation hardening. The content is preferably suppressed to 3.5 wt % or below when reduction in the production cost is of a great importance.

(3) Cu in an Amount of 5 wt % or Less:

Hot brittleness of the steel can be suppressed by Cu addition. When the foregoing aging precipitation hardening is carried out, Cu also plays an important role in generating a nucleus wherefrom the (Ni, Al)-base compound, in particular the α'-phase (NiAl) compound can grow, which is particularly effective for the case the Ni and Al contents are relatively small. Cu is also effective in improving the machinability in a solution treated state. It is necessary to add Cu in an amount of 0.5 wt % or more if some effect by the aging precipitation hardening is expected. The Cu content exceeding 5 wt % will however result in lowered hot workability, and will be disadvantageous in terms of economy. The Cu content is preferably suppressed to 1.7 wt % or below when suppression of hot brittleness and reduction in the production cost are matters of priority.

(4) Al in an Amount of 3 wt % or Less:

Although Al is added as a deoxidizing agent, excessive addition thereof will adversely affect the surface finishing property in mirror polishing. So that the Al content is limited to 3 wt % or less. On the other hand, when the foregoing aging precipitation hardening is carried out, Al is an essential component element for composing the foregoing (Ni, Al)-base compound, and is to be contained at least 0.5 wt % in order to fully attain the precipitation hardening effect. The excessive addition in such case will however result in excessive precipitation or coarsening of the (Ni, Al)-base compound, to thereby degrade workability and toughness, and thus ruin the productivity. The Al content is preferably suppressed to 1.5 wt % or below when excellent toughness and workability are matters of priority.

By thus adding Ni, Cu and Al, operation and effect similar to those disclosed in Japanese Laid-Open Patent Publication No. 60-67641 are obtained. Thus the free-cutting tool steel of the present invention can be provided as a tool steel which desirably retains all other excellent properties disclosed in the publication, and additionally has an excellent machinability. An exemplary composition contains 0.001 to 0.4 wt % of C, 0.5 to 5 wt % of Cu, 1 to 5 wt % of Ni, and 0.5 to 3 wt % of Al. When there is no special requirement for particularly excellent corrosion resistance, it is more advantageous to suppress the Cr content described later to 10 wt % or less for the purpose of improving the machinability.

(5) At Least Either of Ti and Zr Contained so that X (wt %)$=W_{Ti}+0.52W_{Zr}$ amounts to 0.03 to 3.5 wt %, where $W_{Ti}$ represents Ti content (wt %) and $W_{Zr}$ represents Zr content (wt %):

Ti and Zr are essential component elements of the machinability improving compound phase which plays a principal role in exhibiting improving effect of the machinability of the free-cutting tool steel of the present invention. A value of $W_{Ti}+0.52W_{Zr}$ less than 0.03 wt % will result in an insufficient amount of production of the machinability improving compound phase, so that a sufficient improving effect of the machinability cannot be expected. On the contrary, an excessive value of $W_{Ti}+0.52W_{Zr}$ will lower the machinability since (Ti, Zr) forms some other compounds with other element. So that X (wt %)=$W_{Ti}+0.52W_{Zr}$ is necessarily limited to 3.5 wt % or below. It is to be noted that a part of (Ti, Zr) as a metallic component element for composing the machinability improving compound phase may be substituted by V. For such case, (Ti, Zr, V) is properly adjusted so that X' (wt %) $W_{Ti}+0.52W_{Zr}+0.94W_V$ amounts to 0.03 to 3.5 wt %.

It has been known almost empirically that the foregoing machinability improving compound phase such as $M_4Q_2C_2$-base compound phase has an almost constant stoichiometric bonding ratio of bonded component Q or C in respect to the metal component M, and that the machinability is essentially governed by the ratio of formation area of such compound. So that it is often more convenient to describe content of M and Q as indices for estimating the amount of phase formation in an atomic basis rather than weight basis. In this specification, the component M is expressed in a relative atomic content on the basis of Ti, that is, in a form of an optimum content range expressing values equivalent to the weight of the same number of Ti atoms. On the other hand, the component Q described later is expressed in a relative atomic content on the basis of S, that is, in a form of an optimum content range expressing values equivalent to the weight of the same number of S atoms. It is for this purpose that $W_{Zr}$ for expressing the component M is multiplied by a coefficient of 0.52. For the case that other subsidiary components are contained, it is preferable that a sum of weight-base contents obtained by multiplying with proper coefficients for converting into the weight of the same number of Ti atoms amounts to 0.03 to 3.5 wt %.

(6) At Least Any One of S, Se and Te (Component Q) Contained so that Y (wt %)=$W_S+0.4W_{Se}+0.25W_{Te}$ Amounts to 0.01 to 1.0 wt %, where $W_S$ Represents S Content (wt %), $W_{Se}$ Represents Se Content (wt %) and $W_{Te}$ Represents Te Content (wt %):

S, Se and Te are valuable elements for improving the machinability. With S, Se and Te contained therein, compounds responsible for improved machinability (the foregoing machinability improving compound phase, MnS, etc.) are formed in the steel. So that the lower limits of S, Se and Te contents are respectively set to 0.01 wt % where effect of the addition becomes eminent. Excessive addition of these elements will however increase portions of S, Se and Te remained unconsumed for the production of the compounds, to thereby degrade the hot workability. Of course the amount of formation of the machinability improving compound phase will increase with the contents of S, Se and Te, but excessive formation thereof will degrade the mirror surface smoothness. Thus the upper limit of the contents is limited to 1.0 wt %. To fully attain the improving effect of the machinability by virtue of the machinability improving compound phase, it is preferable to properly adjust the contents of S, Se and Te depending on the contents of C, Ti, Zr, V and so forth. If there is a demand for further improving the machinability by producing not only the machinability improving compound phase but also other sulfides (e.g., MnS, TiS) at the same time, it is preferable to add S, Se and Te in some larger amounts depending on the necessary amount. It is to be noted that also for the component Q, it is preferable that a sum of weight-base contents obtained by multiplying with proper coefficients for converting into the weight of the same number of S atoms amounts to 0.01 to 1.0 wt %.

The machinability improving compound phase can be formed as being dispersed in the texture of the tool steel. In particular, fine dispersion of such compound in the texture of the tool steel can further improve the machinability of the steel. In view of emphasizing such effect, the machinability improving compound phase preferably has the foregoing average grain size of 1 to 5 $\mu$m.

The free-cutting tool steel of the present invention has a ratio of Charpy impact values $I_T/I_L$ of 0.3 or above, where $I_T$ is a Charpy impact value of a T-directional test piece and $I_L$ is a Charpy impact value of an L-directional test piece:

such impact values being obtained in Charpy impact test specified by JIS Z2242; wherein such T-directional test piece and L-directional test piece are fabricated as No. 3 test pieces specified in JIS Z2202 by notching a forged-and-rolled product of such tool steel along the directions parallel to and normal to the forging-and-rolling direction, respectively.

Such formation of the machinability improving compound phase within the tool steel can successfully suppress the directional dependence of the toughness in the forging direction (L-direction) and a direction normal thereto (T-direction) in the rolled and forged steel material obtained after rolling and forging of such tool steel. Specifically, in the rolled and forged steel material obtained after rolling and forging of such tool steel, toughness deterioration in the T-direction is suppressed relative to in the L-direction. More specifically, thus defined ratio $I_T/I_L$, where $I_T$ and $I_L$ are Charpy impact values in the T-direction and L-direction, respectively, is adjusted to 0.3 or above, which value is equivalent to that obtained for a base tool steel having added thereto no elements for improving machinability, nor having formed therein no machinability improving compound phase. A value of $I_T/I_L$ is more preferably 0.5 or above.

An area ratio of the machinability improving compound phase observed in a polished surface of the material is preferably 0.1 to 10%. For the purpose of obtaining improving effect of the machinability by forming such machinability improving compound phase, such phase must be contained in an amount of 0.1% or more in terms of an area ratio in the polished sectional texture. Excessive formation of such machinability improving compound phase will however be no more effective due to saturation of such effect. The excessive formation of the machinability improving compound phase may even result in degraded toughness in the forging direction (L-direction) and a direction normal thereto (T-direction) after rolling and forging of such tool steel, so that the area ratio in the polished sectional texture is set to 10% or below.

Other additional conditions in relation to the composition of the tool steel of the present invention will be explained.

(7) Relations (referred to as "condition A", hereinafter) of $0.2X \leqq Y \leqq X$; and $0.07X \leqq W_C \leqq 0.75X$ are satisfied, where $W_C$ represents C content (wt %):

Balance among contents of component elements C, S, Se, Te, Ti, Zr and so forth is important factor to obtain the machinability improving compound phase which is effective enough to improve the machinability. The machinability improving compound phase can be obtained in a proper amount so far as the condition A is satisfied. According to the condition A, the (S, Se, Te) content is preferably somewhat lower than the (Ti, Zr) content. For the purpose of forming the machinability improving compound phase together with (Ti, Zr), it is preferable that the (S, Se, Te) content preferably satisfies a relation of $0.2X \leqq Y$. On the other hand, an excessive (S, Se, Te) content relative to the (Ti, Zr) content will result in excessive formation of sulfides such as MnS, which may be causative of apparent directional dependence of the toughness. So that it is also preferable to satisfy a relation of $Y \leqq X$.

Carbon content is defined so that a relation of $0.07X \leqq W_C$ is satisfied in consideration of introducing a least necessary amount thereof for composing the machinability improving compound phase, and attaining hardness suitable for the tool steel and desirable hardenability. If, on the other hand, carbon content is excessive relative to the (Ti, Zr) content, the residual carbon component not contributable to the formation of the machinability improving compound phase may form other compounds with other elements, to thereby degrade the machinability. So that it is also preferable of satisfy a relation of $W_C \leqq 0.75X$.

More preferably, relations (referred to as "condition B", hereinafter) of $0.2X \leqq Y \leqq 0.67X$; and $0.07X \leqq W_C \leqq 0.5X$ are satisfied. Such control of the compositional components C, S, Se, Te, Ti and Zr can successfully produce a more desirable amount of the machinability improving compound phase for the purpose of improving the machinability and suppressing the directional dependence of the toughness. For the case that V is incorporated into the machinability improving compound phase, the foregoing X is preferably substituted by $X' = W_{Ti} + 0.52W_{Zr} + 0.94W_V$, and the (Ti, Zr, V) content is controlled so as to satisfy the condition A or B.

(8) Si in an Amount of 2 wt % or Less:

Although Si is added as a deoxidizing agent, excessive addition thereof will undesirably degrade the toughness. So that the Si content is preferably limited to 2 wt % or less. On the other hand, there is also a case that Si is intentionally added in order to raise the hardness after solution heat treatment (typically in an amount up to approx. 1 wt %). For the purpose of improving the hardness after solution heat treatment, it is preferable to add Si in an amount of 0.1 wt % or more.

(9) Mn in an Amount of 3 wt % or Less:

The element is valuable for improving the hardenability, and also improving the hardness. Excessive addition thereof, however, may inhibit the formation of the machinability improving compound phase, so that a content as low as possible is preferred so far as the hardness can be ensured at a desirable level. A larger amount of addition is, however, preferred for the case MnS is used to further improve the hardness, together with the machinability exhibiting phase. In such case, an optimum amount of addition will be determined in consideration of balancing the anisotropy of the mechanical properties (strength, toughness, etc.), mirror surface smoothness and corrosion resistance. It is to be noted that excessive content of Mn will result in excessive formation of MnS, so that the machinability improving compound phase will not fully be obtained due to shortage of S, and the foregoing directional dependence of the toughness will become more apparent. It is thus preferable to suppress the content to 3 wt % or less. It is also to be noted that Mn is also valuable as a deoxidizing agent during the refining, and may inevitably be included.

(10) Cr in an Amount of 22 wt % or Less:

Cr has improving effects of the hardenability and hardness. Excessive content thereof, however, will results in the formation of chromium carbide, which may inhibit the formation of the machinability improving compound phase and may be causative of degraded machinability. So that it is preferable to suppress the content to 22 wt % or less. In view of improving the hardness, a content of 0.1 wt % or more is preferable. On the other hand, a content of 12 wt % or more is preferable for the purpose of obtaining improving effect of the corrosion resistance (more specifically 10 to 22 wt %).

(11) Mo and/or W Contained so that $W_{Mo} + 0.5W_W$ Amounts to 4 wt % or Less, Where $W_{Mo}$ Represents Mo Content (wt %) and $W_W$ Represents W Content (wt %):

Mn and W can improve the hardenability, and can form carbides to thereby harden the matrix and improve the wear resistance. Excessive contents thereof, however, degrade the toughness, so that the content is preferably suppressed so that $W_{Mo} + 0.5W_W$ amounts to 4 wt % or less. A content of 0.1 wt % or more will be preferable to ensure the distinct effects.

(12) At Least One Selected from Co in an Amount of 2 wt % or less, Nb in an amount of 1 wt % or less and V in an amount of 1 wt %:

Either element can disperse into the steel and improve the toughness thereof. V can be one component element of the machinability improving compound phase. For the purpose of obtaining distinct effects, it is preferable to contain Co in an amount of 0.001 wt % or more, Nb in an amount of 0.01 wt % or more, and V in an amount of 0.01 wt % or more. On the other hand, excessive contents thereof may reduce the improving effect of the machinability due to undesired formation of the carbides, so that it is more preferable to contain Co in an amount of 2 wt % or less, and Nb and V respectively in an amount of 1 wt % or less.

(13) N Contained in an Amount of 0.04 wt % or Less, and O in an amount of 0.03 wt % or less:

These elements can bind with Ti, Zr or V, which are component elements of the machinability improving compound phase, or with other element such as Al, to thereby form nitrides and oxides, respectively. Such nitrides and oxides are hard, and may sometimes grow larger, which is causative of degraded machinability. So that the contents thereof are preferably suppressed as low as possible, which are typified by the N content of 0.04 wt % or less, and the O content of 0.03 wt % or less. It is more preferable to suppress the N content to 0.01 wt % or less, and the O content to 0.01 wt % or less, while it is a matter of balance with the production cost.

(14) Ca in an Amount of 0.005 wt % or Less:

The element is valuable for improving the hot workability. It is also responsible for improving the machinability through formation of sulfide and oxide. A small amount of addition thereof can shorten the length of inclusion grains such as MnS grain, and can improve the mirror surface smoothness. An amount of addition of 0.0005 wt % or more is preferable in order to obtain a distinct effect. The excessive addition, however, will be no more effective due to saturation of such effect, and will degrade the strength and corrosion resistance, so that the upper limit of the content is set to 0.005 wt %.

(15) Pb and/or Bi in an Amount of 0.2 wt %:

These elements can disperse into the steel and further improve the machinability. For the purpose of obtaining more distinct effect, at least either of the elements will be added in an amount of 0.01 wt % or more. The excessive addition will, however, degrade the hot workability, so that the upper limits are set as described in the above.

(16) Ta in an Amount of 0.05 wt %:

The element is responsible for forming fine carbide, downsizing the crystal grain of the steel, and improving the toughness. An amount of addition of 0.01 wt % or more is preferable for obtaining more distinct effect. The excessive addition, on the other hand, may sometimes degrade the toughness, so that the upper limit is set as described in the above.

(17) B in an Amount of 0.01 wt %:

The element is responsible for improving the hardenability. An amount of addition of 0.0015 wt % or more is preferable for obtaining more distinct effect. The excessive addition, on the other hand, will degrade the hot workability and toughness, so that the upper limit is set as described in the above. An amount of addition of 0.0025 wt % is most preferable, with which a largest improving effect of the hardenability can be attained.

(18) Rare Earth Metal Element in an Amount of 0.5 wt %:

These elements are valuable in fixing impurities such as O, P and so forth, raising cleanliness of the base material, and improving the toughness. An amount of addition of 0.1 wt % or more is preferable for obtaining distinct effect. Excessive addition will, however, be causative of cracks in the base, so that the upper limit is set as described in the above. The rare earth elements is at least one selected from Sc, Y, La, Ce, Pr, Nd, Sm, Eu, Gd, Tb, Dy, Ho, Er, Tm, Yb and Lu.

The free-cutting tool steel of the present invention is preferably used as a source material for die for molding plastics. In response to recent growing demand for faster commodity development of die for molding plastics, it has been becoming a general practice to subject such material to annealing before the delivery. This has raised a problem in the machinability when the material is machined to produce the die having a desired shape. On the contrary, applying the free-cutting tool steel of the present invention to the die for molding plastics facilitates such machining of the die into desired shape, which successfully improves the productivity.

More specifically, the tool steel of the present invention can preferably be used for die for molding plastics for which corrosion resistance and rust-proof property are required (e.g., die having water hole), die for molding vinyl chloride (e.g., telephone casing, rain gutter, other various containers), die used under halogen-base containing gas atmosphere, jig for which corrosion resistance is required (e.g., vices), die for molding corrosion-resistant, mirror-surfaced, high-hardness plastics, die for molding optical lenses, die for molding medical instruments, die for molding cosmetic containers, precision moldings (maintenance-free mother die, wear plate, mother die for molding PET bottles, dies for molding rubbers), die for molding IC packages, die for molding optical disks, and compositional material per se of waveguide plate or reflective plate, or material for composing die for molding thereof.

The free-cutting tool steel according to the first and second aspects of the present invention successfully attains a sufficient level of machinability without intentionally using Pb or the like, by virtue of the machinability improving compound phase, and is thus not causative of environmental impact unlike the conventional tool steel.

DETAILED DESCRIPTION OF THE PREFERRED EMBODIMENTS

Figure 1:
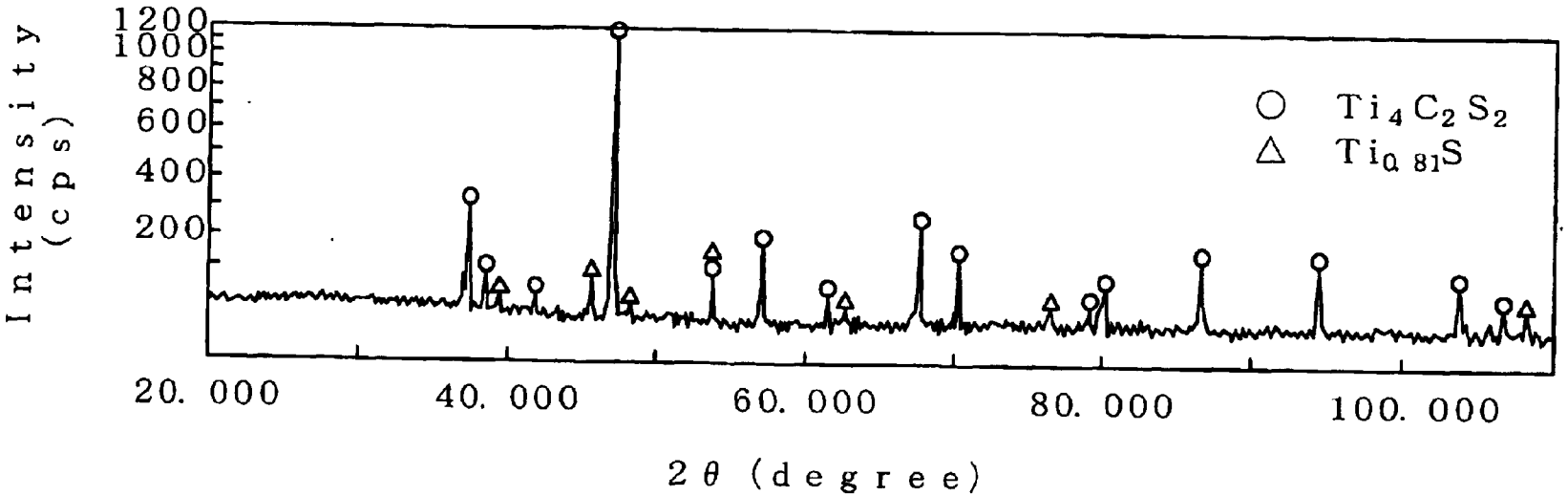
FIG. 1 is an X-ray diffraction profile of invented steel No. 6 in Example 1.

The following experiments were carried out to confirm effects of the free-cutting tool steel according to the first aspect of the present invention.

EXAMPLE 1

As exemplary alloys having the foregoing composition (1), various alloys listed in Tables 1 and 2 (classification of base compositions were given in the remarks column of Table 4) were melted in a vacuum induction heater, and individually molded into a 150-kg ingot. The obtained ingot was hot-forged at 1,200° C. to thereby produce a steel strip of 60 mm thick and 65 mm wide. The obtained steel strip was subjected to annealing in which the strip was first allowed to stand at 870° C. for 5 hours and then cooled at a cooling speed of 15° C./h.

From such annealed steel strip, a base material for producing test pieces for Charpy impact test (No. 3 test pieces specified in JIS Z2202, and having a so-called 2-mm U notch) and a base material for producing test pieces for machinability test were individually cut out. The test pieces for Charpy impact test were produced in a paired manner, where one of which is a T-directional test piece having a notching direction thereof parallel to the forging-and-rolling direction in the hot forging, and the other of which is an L-directional test piece having a notching direction normal thereto. One of the test pieces for the machinability test was finished on the surface thereof, to thereby produce an annealed machinability test piece.

Next, each one of the base materials for producing Charpy impact test pieces and for machinability test pieces was subjected to normalized or quench-and-temper according to predetermined conditions specified by the individual base compositions shown in Table 1, and then surface-finished to thereby finally obtain test pieces for Charpy impact test and quenched-and-tempered machinability test (note that only a steel having a base composition of S55C was normalized) The base material for producing machinability test pieces was also tested in Rockwell C-scale hardness in compliance with JIS Z2245 (note that only S55C-series material was tested in Shore hardness in compliance with JIS Z2246)

TABLE 1

① Normalizing

| Series of steel | Normalizing condition | Hardness |
|---|---|---|
| S55C-series steel | 850° C. × 30 min. → air cooling | HS30 |

TABLE 1-continued

② Quench-and-Temper

| Series of steel | Quenching condition | Tempering condition | Hardness |
|---|---|---|---|
| P20-series modified steel | 970° C. × 30 min. → oil quenching | 600° C.~610° C. × 1 h → air cooling, once | HRC30 |
| SKD61-series steel | 1030° C. × 30 min. → oil quenching | 600° C.~615° C. × 1 h → air cooling, twice | HRC45 |
| 5% Cr-3% Mo-series steel | 1030° C. × 30 min. → oil quenching | 625° C.~645° C. × 1 h → air cooling, twice | HRC45 |
| SKD8-series steel | 1140° C. × 30 min. → oil quenching | 610° C.~630° C. × 1 h → air cooling, twice | HRC48 |
| SKT4-series | 850° C. × 30 min. → oil quenching | 540° C.~560° C. × 1 h → air cooling, twice | HRC45 |
| SKS11-series steel | 780° C. × 30 min. → water quenching | 160° C.~200° C. × 1 h → air cooling, twice | HRC62 |
| SK3-series steel | 780° C. × 30 min. → water quenching | 160° C.~190° C. × 1 h → air cooling, twice | HRC63 |
| SKS4-series steel | 850° C. × 30 min. → oil quenching | 170° C.~200° C. × 1 h → air cooling, twice | HRC53 |
| SKS51-series steel | 820° C. × 30 min. → oil quenching | 410° C.~440° C. × 1 h → air cooling, twice | HRC45 |
| SKD12-series steel | 950° C. × 20 min. → air quenching | 180° C.~200° C. × 1 h → air cooling, twice | HRC60 |
| 8% Cr-series steel | 1030° C. × 20 min. → air quenching | 530° C.~540° C. × 1 h → air cooling, twice | HRC60 |
| SKD11-series steel | 1030° C. × 20 min. → air quenching | 180° C.~200° C. × 1 h → air cooling, twice | HRC60 |
| SKD1-series steel | 1030° C. × 20 min. → air quenching | 180° C.~200° C. × 1 h → air cooling, twice | HRC60 |
| SKH51-series | 1210° C. × 3 min. → oil quenching | 540° C.~560° C. × 1 h → air cooling, three times | HRC66 |
| SKH10-series | 1210° C. × 3 min. → oil quenching | 520° C.~560° C. × 1 h → air cooling, three times | HRC67 |
| SKH58-series | 1220° C. × 3 min. → oil quenching | 530° C.~550° C. × 1 h → air cooling, three times | HRC69 |
| matrix high-speed-steel-series | 1150° C. × 3 min. → oil quenching | 520° C.~550° C. × 1 h → air cooling, three times | HRC62 |

The T-directional test piece having a notching direction parallel to the forging-and-rolling direction and the L-directional test piece normal thereto were tested in Charpy impact test specified in JIS Z2242, and a ratio of Charpy impact values $I_T/I_L$ (T/L), where $I_T$ is a Charpy impact value of a T-directional test piece and $I_L$ is a Charpy impact value of an L-directional test piece. The machinability test was then carried out using the annealed test piece (SA) and quenched-and-tempered test piece (HT) according to the conditions described below. That is, the annealed material and quenched-and-tempered material were cut with a cemented carbide end mill, and the machinability was evaluated based on the cutting length until the wear width of the flank reaches 0.3 mm. Results were expressed in a relative manner assuming the cutting length of the conventional steel as 100. The cutting was carried out using a single-blade, cemented carbide end mill as being lubricated with cutting oil (wet cutting), where the test conditions include a cutting width of 1 mm, cutting depth of 3 mm, cutting speed of 50 mm/min, and amount of feed of sample material of 0.05 mm/blade.

The surface of the test piece after Charpy impact test was mirror-polished, and the polished surface was subjected to SEM observation and EPMA surface analysis, to thereby determine ratio of area where TICS was formed. An X-ray analysis revealed that the TICS was mainly composed of the foregoing $M_4Q_2C_2$ compound phase. Results were shown in Table 4.

TABLE 2

| | | Chemical component ① (wt %) | | | | | | | | | | |
|---|---|---|---|---|---|---|---|---|---|---|---|---|
| Discrimination | No | C | Si | Mn | P | Cu | Ni | Cr | Mo | W | Mo + 0.5W | V |
| conventional steel | 1 | 0.55 | 0.25 | 0.94 | 0.017 | 0.08 | 0.08 | 0.21 | * | * | * | * |
| comparative steel | 2 | 0.56 | 0.24 | 0.94 | 0.015 | 0.07 | 0.08 | 0.23 | * | * | * | * |
| comparative steel | 3 | 0.55 | 0.26 | 0.95 | 0.016 | 0.08 | 0.07 | 0.23 | * | * | * | * |
| invented steel | 4 | 0.57 | 0.26 | 0.96 | 0.014 | 0.07 | 0.05 | 0.25 | * | * | * | * |
| comparative steel | 5 | 0.55 | 0.25 | 0.98 | 0.017 | 0.06 | 0.07 | 0.22 | * | * | * | * |
| invented steel | 6 | 0.59 | 0.24 | 0.93 | 0.015 | 0.05 | 0.06 | 0.23 | * | * | * | * |
| invented steel | 7 | 0.58 | 0.26 | 0.96 | 0.015 | 0.07 | 0.06 | 0.22 | * | * | * | * |
| invented steel | 8 | 0.59 | 0.25 | 0.97 | 0.026 | 0.15 | 0.35 | 0.24 | 0.15 | 0.13 | 0.22 | 0.08 |
| comparative steel | 9 | 0.57 | 0.25 | 0.94 | 0.015 | 0.08 | 0.06 | 0.24 | * | * | * | * |
| invented steel | 10 | 0.59 | 0.25 | 0.97 | 0.016 | 0.07 | 0.05 | 0.24 | * | * | * | * |
| comparative steel | 11 | 0.57 | 0.24 | 0.95 | 0.014 | 0.08 | 0.08 | 0.23 | * | * | * | * |
| conventional steel | 12 | 0.17 | 0.08 | 1.85 | 0.008 | 0.06 | 0.14 | 1.98 | 0.55 | * | 0.55 | 0.12 |
| comparative steel | 13 | 0.18 | 0.07 | 1.86 | 0.009 | 0.08 | 0.15 | 1.97 | 0.55 | * | 0.55 | 0.1 |
| invented steel | 14 | 0.19 | 0.08 | 1.84 | 0.008 | 0.08 | 0.15 | 1.97 | 0.56 | * | 0.56 | 0.11 |
| invented steel | 15 | 0.18 | 0.09 | 1.86 | 0.007 | 0.07 | 0.16 | 1.96 | 0.55 | * | 0.55 | 0.11 |
| comparative steel | 16 | 0.18 | 0.08 | 1.86 | 0.009 | 0.06 | 0.13 | 1.95 | 0.54 | * | 0.54 | 0.1 |
| invented steel | 17 | 0.19 | 0.09 | 1.85 | 0.009 | 0.07 | 0.14 | 1.96 | 0.54 | * | 0.54 | 0.12 |
| invented steel | 18 | 0.18 | 0.07 | 1.85 | 0.007 | 0.08 | 0.15 | 1.98 | 0.42 | 0.22 | 0.53 | 0.11 |
| invented steel | 19 | 0.19 | 0.08 | 1.86 | 0.008 | 0.07 | 0.13 | 1.97 | 0.53 | * | 0.53 | 0.13 |
| comparative steel | 20 | 0.19 | 0.09 | 1.84 | 0.008 | 0.06 | 0.16 | 1.95 | 0.54 | * | 0.53 | 0.12 |

TABLE 3

| | | Chemical component ② (wt %) | | | | | | | | | | | |
|---|---|---|---|---|---|---|---|---|---|---|---|---|---|
| Discrimination | No | Co | Ti | Zr | Ti + 0.52Zr | S | Se | Te | S + 0.45e + 0.25Te | S—Al | O | N | Others |
| conventional steel | 1 | * | * | * | * | 0.001 | * | * | 0.001* | 0.015 | 0.0028 | 0.013 | * |
| comparative steel | 2 | * | 0.02 | * | 0.02 | 0.008 | * | * | 0.008* | 0.017 | 0.0027 | 0.015 | * |
| comparative steel | 3 | * | * | * | *• | 0.015 | * | * | 0.015 | 0.014 | 0.0025 | 0.012 | * |
| invented steel | 4 | * | 0.048 | * | 0.048 | 0.016 | * | * | 0.016 | 0.014 | 0.0027 | 0.015 | * |
| comparative steel | 5 | * | * | * | *• | 0.12 | * | * | 0.12 | 0.013 | 0.0028 | 0.013 | * |
| invented steel | 6 | * | 0.37 | * | 0.37 | 0.13 | * | * | 0.13 | 0.016 | 0.0026 | 0.016 | * |
| invented steel | 7 | * | 0.04 | 0.67 | 0.39 | 0.1 | 0.06 | 0.01 | 0.1265 | 0.017 | 0.0028 | 0.013 | * |
| invented steel | 8 | 0.38 | 0.19 | 0.36 | 0.38 | 0.1 | 0.05 | 0.03 | 0.1275 | 0.015 | 0.0025 | 0.014 | Ca = 0.0012<br>Pb = 0.12<br>Bi = 0.15<br>Nb = 0.008<br>Ta = 0.012<br>REM = 0.13 |
| comparative steel | 9 | * | * | * | * | 0.85 | * | * | 0.85 | 0.015 | 0.0025 | 0.017 | * |
| invented steel | 10 | * | 2.48 | * | 2.48 | 0.83 | * | * | 0.83 | 0.017 | 0.0024 | 0.015 | * |
| comparative steel | 11 | * | 3.8 | * | 3.8 | 1.2 | * | * | 1.2 | 0.016 | 0.0026 | 0.016 | * |
| conventional steel | 12 | * | * | * | * | 0.001 | * | * | 0.001 | 0.021 | 0.0016 | 0.018 | * |
| comparative steel | 13 | * | * | * | * | 0.027 | * | * | 0.027 | 0.022 | 0.0018 | 0.017 | * |
| invented steel | 14 | * | 0.074 | * | 0.074 | 0.027 | * | * | 0.027 | 0.02 | 0.0017 | 0.017 | * |
| invented steel | 15 | * | 0.025 | 0.1 | 0.077 | 0.003 | 0.036 | 0.034 | 0.026 | 0.021 | 0.0016 | 0.019 | * |
| comparative steel | 16 | * | * | * | * | 0.052 | * | * | 0.052 | 0.019 | 0.0015 | 0.018 | * |
| invented steel | 17 | * | 0.12 | 0.06 | 0.151 | 0.05 | * | * | 0.05 | 0.018 | 0.0018 | 0.016 | * |
| invented steel | 18 | 0.25 | 0.158 | * | 0.158 | 0.035 | 0.024 | 0.022 | 0.05 | 0.02 | 0.0017 | 0.017 | Ca = 0.0008<br>Pb = 0.02<br>Bi = 0.02<br>Bi = 0.012<br>Bi = 0.013<br>Bi = 0.014 |
| invented steel | 19 | * | 0.09 | * | 0.09 | 0.06 | * | * | 0.06 | 0.02 | 0.0018 | 0.019 | Bi = 0.015 |
| comparative steel | 20 | * | 3.02 | 1.06 | 3.57 | 0.95 | 0.38 | 0.38 | 1.2 | 0.022 | 0.0029 | 0.0018 | Bi = 0.016 |

TABLE 4

| | | Machinability | | Charpy impact value (J/cm2) | | Anisotropy | | TICS area ratio | Remarks |
|---|---|---|---|---|---|---|---|---|---|
| Discrimination | No | SA | HT | L direction | T direction | T/L | TI/S | (%) | (Standard steel) |
| conventional steel | 1 | 1 | 1 | 63 | 40 | 0.63 | * | 0 | S55C-series modified |
| comparative steel | 2 | 1.2 | 1.5 | 62 | 39 | 0.63 | 2.5 | 0.08 | LOW TICS |
| comparative steel | 3 | 4.3 | 5 | 61 | 33 | 0.54 | * | 0 | A |
| invented steel | 4 | 4.2 | 5 | 61 | 38 | 0.62 | 3 | 0.16 | A |
| comparative steel | 5 | 43 | 55 | 56 | 27 | 0.48 | * | 0 | B |
| invented steel | 6 | 56 | 70 | 57 | 33 | 0.58 | 2.8 | 1.28 | B |
| invented steel | 7 | 53 | 65 | 55 | 34 | 0.62 | 3.1 | 1.26 | B |
| invented steel | 8 | 69 | 88 | 54 | 31 | 0.57 | 3 | 1.3 | B |
| comparative steel | 9 | 330 | 415 | 48 | 10 | 0.21 | | 0 | C |
| invented steel | 10 | 320 | 400 | 47 | 19 | 0.40 | 3 | 8.54 | C |
| comparative steel | 11 | 390 | 500 | 39 | 17 | 0.44 | 3.2 | 12.08 | High TICS |
| conventional steel | 12 | 1 | 1 | 70 | 54 | 0.77 | * | 0 | P20-series modified |
| comparative steel | 13 | 3.8 | 4.7 | 68 | 47 | 0.69 | * | 0 | A |
| invented steel | 14 | 4 | 5 | 67 | 53 | 0.79 | 2.7 | 0.26 | A |
| invented steel | 15 | 3.7 | 4.8 | 67 | 54 | 0.81 | 3 | 0.24 | A |
| comparative steel | 16 | 10 | 13 | 65 | 41 | 0.63 | * | 0 | B |
| invented steel | 17 | 11 | 12 | 64 | 49 | 0.77 | 3 | 0.48 | B |
| invented steel | 18 | 24 | 22 | 63 | 47 | 0.75 | 3.2 | 0.51 | B |
| invented steel | 19 | 10 | 12 | 64 | 46 | 0.72 | 1.5 | 0.35 | B |
| comparative steel | 20 | 380 | 470 | 44 | 23 | 0.52 | 3 | 11.9 | High TICS |

As is clear from the results, of the alloys having the same base composition, those satisfying the composition of the present invention are more excellent in the machinability both in the annealed and quenched-and-tempered (and normalized) states, and smaller in the difference between Charpy impact values between the T-direction and L-direction, which indicates improvement in the anisotropy.

EXAMPLE 2

As exemplary alloys having the foregoing composition (2), various alloys listed in Tables 5 and 6 (classification of base compositions were given in the remarks column of Table 7) were melted and individually molded into an ingot similarly to Example 1. The obtained ingot was hot-forged similarly to Example 1, and obtained steel strip was further annealed. From such annealed steel strip, base materials for producing Charpy impact test pieces and machinability test pieces were individually cut out similarly to Example 1. One of the base material for producing the test pieces for the machinability test was finished on the surface thereof, to thereby produce an annealed machinability test piece. Next, each one of the base materials for producing Charpy impact test pieces and for machinability test pieces was subjected to quench-and-temper according to predetermined conditions specified by the individual base compositions shown in Table 1, and then surface-finished to thereby finally obtain test pieces for Charpy impact test and quenched-and-tempered machinability test. These test pieces were subjected to Rockwell C-scale hardness test, Charpy impact test and machinability test similarly to Example 1. The surface of the test piece after Charpy impact test was mirror-polished, and the polished surface was subjected to SEM observation and EPMA surface analysis, to thereby determine ratio of area where TICS was formed. An X-ray analysis revealed that the TICS was mainly composed of the foregoing $M_4Q_2C_2$ compound phase. Results were shown in Table 7.

TABLE 5

| | | Chemical component ① (wt %) | | | | | | | | | | |
|---|---|---|---|---|---|---|---|---|---|---|---|---|
| Discrimination | No | C | Si | Mn | P | Cu | Ni | Cr | Mo | W | Mo + 0.5W | V |
| conventional steel | 101 | 0.37 | 1.05 | 0.46 | 0.009 | 0.08 | 0.05 | 5.34 | 1.23 | * | 1.23 | 0.84 |
| comparative steel | 102 | 0.37 | 1.03 | 0.44 | 0.008 | 0.08 | 0.05 | 5.35 | 1.26 | * | 1.26 | 0.86 |
| comparative steel | 103 | 0.38 | 1.04 | 0.45 | 0.008 | 0.08 | 0.06 | 5.36 | 1.27 | * | 1.27 | 0.85 |
| invented steel | 104 | 0.37 | 1.02 | 0.45 | 0.007 | 0.07 | 0.05 | 5.33 | 1.24 | * | 1.24 | 0.85 |
| invented steel | 105 | 0.38 | 1.05 | 0.46 | 0.008 | 0.09 | 0.06 | 5.34 | 1.25 | * | 1.25 | 0.85 |
| comparative steel | 106 | 0.37 | 1.03 | 0.46 | 0.009 | 0.07 | 0.07 | 5.35 | 1.25 | * | 1.25 | 0.84 |
| invented steel | 107 | 0.36 | 1.02 | 0.45 | 0.007 | 0.08 | 0.05 | 5.35 | 1.24 | * | 1.24 | 0.84 |
| comparative steel | 108 | 0.37 | 1.01 | 0.44 | 0.008 | 0.08 | 0.05 | 5.36 | 1.28 | * | 1.24 | 0.85 |
| invented steel | 109 | 0.39 | 1.03 | 0.46 | 0.009 | 0.07 | 0.07 | 5.33 | 1.24 | * | 1.25 | 0.83 |
| comparative steel | 110 | 0.37 | 1.04 | 0.44 | 0.009 | 0.06 | 0.06 | 5.36 | 1.26 | * | 1.26 | 0.85 |
| conventional steel | 111 | 0.33 | 0.05 | 0.59 | 0.009 | 0.05 | 0.35 | 5.45 | 3.08 | * | 3.08 | 0.87 |
| comparative steel | 112 | 0.33 | 0.06 | 0.6 | 0.008 | 0.05 | 0.36 | 5.47 | 3.05 | * | 3.05 | 0.86 |
| invented steel | 113 | 0.36 | 0.05 | 0.61 | 0.007 | 0.06 | 0.34 | 5.44 | 3.04 | * | 3.04 | 0.87 |
| comparative steel | 114 | 0.35 | 0.05 | 0.59 | 0.009 | 0.05 | 0.35 | 5.46 | 3.05 | * | 3.05 | 0.86 |
| invented steel | 115 | 0.36 | 0.07 | 0.6 | 0.008 | 0.07 | 0.34 | 5.45 | 3.06 | * | 3.06 | 0.87 |
| conventional steel | 116 | 0.4 | 0.4 | 0.5 | 0.028 | 0.03 | 0.08 | 4.25 | 0.35 | 4.41 | 2.56 | 0.86 |
| comparative steel | 117 | 0.39 | 0.4 | 0.51 | 0.027 | 0.03 | 0.09 | 4.26 | 0.36 | 4.37 | 2.55 | 0.85 |
| invented steel | 118 | 0.43 | 0.41 | 0.48 | 0.028 | 0.05 | 0.07 | 4.24 | 0.34 | 4.42 | 2.55 | 0.84 |
| comparative steel | 119 | 0.44 | 0.39 | 0.5 | 0.029 | 0.04 | 0.08 | 4.25 | 0.35 | 4.39 | 2.55 | 0.85 |
| invented steel | 120 | 0.45 | 0.41 | 0.49 | 0.027 | 0.04 | 0.08 | 4.27 | 0.35 | 4.38 | 2.54 | 0.86 |
| conventional steel | 121 | 0.51 | 0.25 | 0.85 | 0.016 | 0.08 | 1.86 | 1.2 | 0.35 | * | 0.35 | 0.15 |
| comparative steel | 122 | 0.51 | 0.26 | 0.84 | 0.018 | 0.07 | 1.87 | 1.22 | 0.34 | * | 0.34 | 0.15 |
| invented steel | 123 | 0.52 | 0.25 | 0.86 | 0.017 | 0.09 | 1.85 | 1.21 | 0.35 | * | 0.35 | 0.16 |
| comparative steel | 124 | 0.5 | 0.24 | 0.85 | 0.016 | 0.07 | 1.85 | 1.2 | 0.35 | * | 0.35 | 0.14 |
| invented steel | 125 | 0.5 | 0.25 | 0.84 | 0.018 | 0.08 | 1.86 | 1.19 | 0.34 | * | 0.34 | 0.16 |
| invented steel | 126 | 0.53 | 0.24 | 0.86 | 0.015 | 0.07 | 1.86 | 1.21 | 0.36 | * | 0.36 | 0.16 |

TABLE 6

| | | Chemical component ② (wt %) | | | | | | | | | | | |
|---|---|---|---|---|---|---|---|---|---|---|---|---|---|
| Discrimination | No | Co | Ti | Zr | Ti + 0.52Zr | S | Se | Te | S + 0.45e + 0.25Te | S—Al | O | N | Others |
| conventional steel | 101 | * | * | * | 0 | 0.001 | * | * | 0.001 | 0.01 | 0.0021 | 0.016 | * |
| comparative steel | 102 | * | 0.03 | * | 0.03 | 0.009 | * | * | 0.009 | 0.013 | 0.0028 | 0.016 | * |
| comparative steel | 103 | * | * | * | 0 | 0.035 | * | * | 0.035 | 0.014 | 0.0026 | 0.019 | * |
| invented steel | 104 | * | 0.09 | * | 0.09 | 0.036 | * | * | 0.036 | 0.011 | 0.0023 | 0.014 | * |
| invented steel | 105 | * | 0.1 | 0.04 | 0.12 | 0.027 | 0.012 | 0.015 | 0.036 | 0.016 | 0.0023 | 0.016 | * |
| comparative steel | 106 | * | * | * | 0 | 0.13 | * | * | 0.13 | 0.016 | 0.0025 | 0.018 | * |
| invented steel | 107 | * | 0.45 | * | 0.45 | 0.14 | * | * | 0.14 | 0.014 | 0.0027 | 0.017 | * |
| comparative steel | 108 | * | * | * | 0 | 0.95 | * | * | 0.95 | 0.015 | 0.0028 | 0.015 | * |
| invented steel | 109 | * | 2.72 | * | 2.72 | 0.96 | * | * | 0.96 | 0.013 | 0.0025 | 0.016 | * |
| comparative steel | 110 | * | 3.3 | * | 3.3 | 1.08 | * | * | 1.08 | 0.014 | 0.0026 | 0.017 | * |
| conventional steel | 111 | 0.5 | * | * | 0 | 0.001 | * | * | 0.001 | 0.02 | 0.0016 | 0.018 | * |
| comparative steel | 112 | 0.48 | * | * | 0 | 0.051 | * | * | 0.051 | 0.018 | 0.0018 | 0.018 | * |
| invented steel | 113 | 0.49 | 0.16 | * | 0.16 | 0.053 | * | * | 0.053 | 0.019 | 0.0017 | 0.017 | * |
| comparative steel | 114 | 0.5 | * | * | 0 | 0.95 | * | * | 0.95 | 0.021 | 0.0018 | 0.019 | * |
| invented steel | 115 | 0.49 | 3.04 | * | 3.04 | 0.91 | 0.12 | * | 0.96 | 0.028 | 0.0017 | 0.018 | * |
| conventional steel | 116 | 4.25 | * | * | 0 | 0.001 | * | * | 0.001 | 0.016 | 0.0028 | 0.032 | * |
| comparative steel | 117 | 4.26 | * | * | 0 | 0.074 | * | * | 0.074 | 0.015 | 0.0026 | 0.03 | * |
| invented steel | 118 | 4.24 | 0.23 | * | 0.23 | 0.039 | * | 0.15 | 0.077 | 0.017 | 0.0025 | 0.031 | * |
| comparative steel | 119 | 4.26 | * | * | 0 | 0.186 | * | * | 0.186 | 0.015 | 0.0025 | 0.032 | * |
| invented steel | 120 | 4.35 | 0.65 | * | 0.65 | 0.182 | * | * | 0.182 | 0.016 | 0.0026 | 0.031 | Ca = 0.0032<br>Pb = 0.02<br>Bi = 0.02<br>Nb = 0.005<br>Ta = 0.017<br>REM = 0.36 |
| conventional steel | 121 | * | * | * | 0 | 0.001 | * | * | 0.001 | 0.001 | 0.0006 | 0.009 | * |
| comparative steel | 122 | * | * | * | 0 | 0.036 | * | * | 0.036 | 0.001 | 0.0008 | 0.008 | * |
| invented steel | 123 | * | 0.11 | * | 0.11 | 0.038 | * | * | 0.038 | 0.001 | 0.0009 | 0.009 | * |
| comparative steel | 124 | * | * | * | 0 | 0.099 | * | * | 0.099 | 0.001 | 0.0007 | 0.007 | * |
| invented steel | 125 | * | 0.29 | * | 0.29 | 0.095 | * | * | 0.095 | 0.001 | 0.0008 | 0.008 | * |
| invented steel | 126 | * | 0.15 | * | 0.15 | 0.095 | * | * | 0.095 | 0.001 | 0.0009 | 0.008 | * |

TABLE 7

| Discrimination | No | Machinability SA | Machinability HT | Charpy impact value (J/cm2) L direction | Charpy impact value (J/cm2) T direction | Anisotropy T/L | Anisotropy Ti/S | TICS area ratio (%) | Remarks (Standard steel) |
|---|---|---|---|---|---|---|---|---|---|
| conventional steel | 101 | 1 | 1 | 40 | 33 | 0.83 | * | 0 | SKD61 |
| comparative steel | 102 | 1.2 | 1.5 | 39 | 32 | 0.82 | 3.3 | 0.07 | low TICS |
| comparative steel | 103 | 4.5 | 5.5 | 38 | 26 | 0.68 | * | 0 | A |
| invented steel | 104 | 4.8 | 6 | 38 | 31 | 0.82 | 2.5 | 0.35 | A |
| invented steel | 105 | 4.3 | 5.5 | 37 | 30 | 0.81 | 3.3 | 0.37 | A |
| comparative steel | 106 | 48 | 60 | 35 | 20 | 0.57 | * | 0 | B |
| invented steel | 107 | 50 | 65 | 34 | 27 | 0.79 | 3.2 | 1.52 | B |
| comparative steel | 108 | 350 | 435 | 26 | 8 | 0.31 | * | 0 | C |
| invented steel | 109 | 360 | 450 | 25 | 15 | 0.60 | 2.8 | 9.43 | C |
| comparative steel | 110 | 410 | 510 | 23 | 13 | 0.57 | 3.1 | 10.85 | high TICS |
| conventional steel | 111 | 1 | 1 | 41 | 39 | 0.95 | * | 0 | 5% Cr-3% Mo-series steel |
| comparative steel | 112 | 5.8 | 7.5 | 39 | 29 | 0.74 | * | 0 | A |
| invented steel | 113 | 5.2 | 6.5 | 38 | 35 | 0.92 | 3 | 0.54 | A |
| comparative steel | 114 | 340 | 450 | 29 | 9 | 0.31 | * | 0 | B |
| invented steel | 115 | 370 | 460 | 27 | 19 | 0.70 | 3.2 | 9.6 | B |
| conventional steel | 116 | 1 | 1 | 38 | 20 | 0.53 | * | 0 | SKD8 |
| comparative steel | 117 | 19 | 25 | 35 | 14 | 0.40 | * | 0 | A |
| invented steel | 118 | 22 | 27 | 34 | 18 | 0.53 | 3 | 0.78 | A |
| comparative steel | 119 | 65 | 85 | 32 | 11 | 0.34 | * | 0 | B |
| invented steel | 120 | 79 | 100 | 30 | 15 | 0.50 | 3.6 | 1.85 | B |
| conventional steel | 121 | 1 | 1 | 58 | 51 | 0.88 | * | 0 | SKT4 |
| comparative steel | 122 | 5.5 | 7 | 55 | 40 | 0.73 | * | 0 | A |
| invented steel | 123 | 6.1 | 7.5 | 56 | 47 | 0.84 | 2.9 | 0.39 | A |
| comparative steel | 124 | 34 | 43 | 52 | 34 | 0.65 | * | 0 | B |
| invented steel | 125 | 34 | 42 | 53 | 43 | 0.81 | 3.1 | 0.95 | B |
| invented steel | 126 | 31 | 44 | 51 | 40 | 0.78 | 1.6 | 0.45 | B |

As is clear from the results, of the alloys having the same base composition, those satisfying the composition of the present invention are more excellent in the machinability both in the annealed and quenched-and-tempered states, and smaller in the difference between Charpy impact values between the T-direction and L-direction, which indicates improvement in the anisotropy.

EXAMPLE 3

As exemplary alloys having the foregoing composition (3), various alloys listed in Tables 8 and 9 (classification of base compositions were given in the remarks column of Table 10) were melted and individually molded into an ingot similarly to Example 1. The obtained ingot was hot-forged similarly to Example 1, and obtained steel strip was further annealed. From such annealed steel strip, base materials for producing Charpy impact test pieces and machinability test pieces were individually cut out similarly to Example 1, except that Charpy impact test pieces were such that having 10-mm R notch in place of the foregoing No. 3 test pieces. One of the base material for producing the test pieces for the machinability test was finished on the surface thereof, to thereby produce an annealed machinability test piece. Next, each one of the base materials for producing Charpy impact test pieces and for machinability test pieces was subjected to quench-and-temper according to predetermined conditions specified by the individual base compositions shown in Table 1, and then surface-finished to thereby finally obtain test pieces for Charpy impact test and quenched-and-tempered machinability test. These test pieces were subjected to Rockwell C-scale hardness test, Charpy impact test and machinability test similarly to Example 1. The surface of the test piece after Charpy impact test was mirror-polished, and the polished surface was subjected to SEM observation and EPMA surface analysis, to thereby determine ratio of area where TICS was formed. An X-ray analysis revealed that the TICS was mainly composed of the foregoing $M_4Q_2C_2$ compound phase. Results were shown in Table 10.

TABLE 8

| Discrimination | No | Chemical component ① (wt %) C | Si | Mn | P | Cu | Ni | Cr | Mo | W | Mo + 0.5W | V | Co |
|---|---|---|---|---|---|---|---|---|---|---|---|---|---|
| conventional steel | 201 | 1.25 | 0.31 | 0.34 | 0.018 | 0.11 | 0.02 | 0.35 | * | 3.52 | 1.76 | 0.21 | * |
| comparative steel | 202 | 1.21 | 0.32 | 0.35 | 0.017 | 0.08 | 0.01 | 0.36 | * | 3.51 | 1.76 | 0.20 | * |
| comparative steel | 203 | 1.21 | 0.32 | 0.33 | 0.015 | 0.13 | 0.03 | 0.35 | * | 3.52 | 1.76 | 0.20 | * |
| invented steel | 204 | 1.30 | 0.31 | 0.32 | 0.017 | 0.13 | 0.01 | 0.35 | * | 3.51 | 1.76 | 0.21 | * |
| invented steel | 205 | 1.32 | 0.32 | 0.33 | 0.015 | 0.12 | 0.02 | 0.36 | * | 3.52 | 1.76 | 0.21 | * |
| comparative steel | 206 | 1.23 | 0.35 | 0.34 | 0.016 | 0.09 | 0.02 | 0.36 | * | 3.53 | 1.77 | 0.20 | * |
| invented steel | 207 | 1.29 | 0.35 | 0.32 | 0.015 | 0.09 | 0.02 | 0.35 | * | 3.50 | 1.75 | 0.21 | * |
| comparative steel | 208 | 1.27 | 0.34 | 0.33 | 0.018 | 0.11 | 0.03 | 0.35 | * | 3.52 | 1.76 | 0.20 | * |
| invented steel | 209 | 1.35 | 0.32 | 0.42 | 0.02 | 0.15 | 0.07 | 0.75 | 1.03 | 1.52 | 1.79 | 0.20 | * |
| invented steel | 210 | 1.29 | 1.01 | 1.32 | 0.018 | 0.12 | 0.02 | 1.02 | 0.76 | 0.01 | 0.77 | 0.10 | * |
| conventional steel | 211 | 1.02 | 0.31 | 0.98 | 0.009 | 0.11 | 0.02 | 1.21 | * | * | 0 | * | * |
| comparative steel | 212 | 1.01 | 0.32 | 0.99 | 0.008 | 0.10 | 0.03 | 1.20 | * | * | 0 | * | * |
| invented steel | 213 | 1.12 | 0.33 | 1.01 | 0.007 | 0.09 | 0.02 | 1.19 | * | * | 0 | * | * |

TABLE 8-continued

| | | Chemical component ① (wt %) | | | | | | | | | | | |
|---|---|---|---|---|---|---|---|---|---|---|---|---|---|
| Discrimination | No | C | Si | Mn | P | Cu | Ni | Cr | Mo | W | Mo + 0.5W | V | Co |
| comparative steel | 214 | 1.01 | 0.32 | 1.03 | 0.008 | 0.11 | 0.02 | 1.22 | * | * | 0 | * | * |
| invented steel | 215 | 1.23 | 0.31 | 1.02 | 0.009 | 0.12 | 0.03 | 1.19 | * | * | 0 | * | * |
| conventional steel | 216 | 0.43 | 0.30 | 0.34 | 0.013 | 0.19 | 0.02 | 0.81 | * | 0.78 | 0.39 | * | * |
| comparative steel | 217 | 0.45 | 0.32 | 0.62 | 0.013 | 0.13 | 0.03 | 0.80 | * | 0.77 | 0.39 | * | * |
| invented steel | 218 | 0.51 | 0.31 | 0.35 | 0.012 | 0.16 | 0.02 | 0.82 | * | 0.79 | 0.40 | * | * |
| comparative steel | 219 | 0.43 | 0.29 | 0.37 | 0.015 | 0.12 | 0.25 | 0.79 | * | 0.78 | 0.39 | * | * |
| invented steel | 220 | 0.58 | 0.31 | 0.35 | 0.012 | 0.11 | 0.02 | 0.80 | * | 0.79 | 0.40 | * | * |
| conventional steel | 221 | 0.81 | 0.32 | 0.45 | 0.018 | 0.17 | 1.67 | 0.38 | * | * | 0 | * | * |
| comparative steel | 222 | 0.82 | 0.31 | 0.46 | 0.017 | 0.14 | 1.68 | 0.37 | * | * | 0 | * | * |
| invented steel | 223 | 0.91 | 0.31 | 0.45 | 0.016 | 0.15 | 1.65 | 0.38 | * | * | 0 | * | * |
| comparative steel | 224 | 0.81 | 0.31 | 0.47 | 0.017 | 0.13 | 1.68 | 0.38 | * | * | 0 | * | * |
| invented steel | 225 | 0.91 | 0.28 | 0.45 | 0.018 | 0.12 | 1.69 | 0.36 | * | * | 0 | * | * |

TABLE 9

| | | Chemical component ②(wt %) | | | | | | | | | | |
|---|---|---|---|---|---|---|---|---|---|---|---|---|
| Discrimination | No | Ti | Zr | Ti + 0.52Zr | S | Se | Te | S + 0.4Se + 0.25Te | S—Al | O | N | Others |
| conventional steel | 201 | * | * | 0 | 0.001 | * | * | 0.001 | 0.014 | 0.0023 | 0.016 | * |
| comparative steel | 202 | * | * | 0 | 0.152 | * | * | 0.152 | 0.015 | 0.0024 | 0.015 | * |
| comparative steel | 203 | 0.031 | 0.03 | 0.047 | 0.008 | * | * | 0.008 | 0.017 | 0.0024 | 0.016 | * |
| invented steel | 204 | 0.312 | * | 0.312 | 0.153 | * | * | 0.153 | 0.013 | 0.0025 | 0.014 | * |
| invented steel | 205 | 0.323 | 0.05 | 0.349 | 0.151 | 0.03 | 0.005 | 0.164 | 0.015 | 0.0022 | 0.013 | * |
| comparative steel | 206 | * | * | 0 | 0.768 | 0.04 | * | 0.784 | 0.016 | 0.0023 | 0.015 | * |
| invented steel | 207 | 2.319 | * | 2.319 | 0.752 | 0.03 | * | 0.764 | 0.015 | 0.0025 | 0.013 | * |
| comparative steel | 208 | 3.458 | * | 3.458 | 1.17 | * | * | 1.17 | 0.016 | 0.0023 | 0.016 | * |
| invented steel | 209 | 1.254 | 0.05 | 1.280 | 0.403 | * | 0.005 | 0.404 | 0.014 | 0.0023 | 0.012 | * |
| invented steel | 210 | 0.672 | * | 0.672 | 0.203 | * | * | 0.203 | 0.015 | 0.0025 | 0.013 | * |
| conventional steel | 211 | * | * | 0 | 0.001 | * | * | 0.001 | 0.021 | 0.0008 | 0.008 | * |
| comparative steel | 212 | * | * | 0 | 0.210 | * | * | 0.210 | 0.023 | 0.0009 | 0.009 | * |
| invented steel | 213 | 0.813 | * | 0.813 | 0.240 | * | * | 0.240 | 0.021 | 0.0009 | 0.008 | * |
| comparative steel | 214 | * | * | 0 | 0.622 | * | * | 0.622 | 0.022 | 0.0009 | 0.007 | * |
| invented steel | 215 | 1.982 | * | 1.982 | 0.626 | 0.02 | * | 0.634 | 0.023 | 0.0007 | 0.008 | Ca = 0.0052<br>Pb = 0.04<br>Bi = 0.06<br>Nb = 0.03<br>Ta = 0.008<br>REM = 0.0036 |
| conventional steel | 216 | * | * | 0 | 0.001 | * | * | 0.001 | 0.008 | 0.0018 | 0.023 | * |
| comparative steel | 217 | * | * | 0 | 0.210 | * | * | 0.210 | 0.008 | 0.0021 | 0.025 | * |
| invented steel | 218 | 0.762 | * | 0.762 | 0.214 | * | * | 0.214 | 0.009 | 0.0018 | 0.021 | * |
| comparative steel | 219 | * | * | 0.320 | 0.672 | * | * | 0.672 | 0.007 | 0.0019 | 0.022 | * |
| invented steel | 220 | 1.723 | 0.02 | 1.733 | 0.675 | 0.03 | * | 0.687 | 0.009 | 0.002 | 0.023 | * |
| conventional steel | 221 | * | * | 0 | 0.001 | * | * | 0.001 | 0.018 | 0.0027 | 0.005 | * |
| comparative steel | 222 | * | * | 0 | 0.167 | * | * | 0.167 | 0.019 | 0.0023 | 0.003 | * |
| invented steel | 223 | 0.382 | * | 0.382 | 0.164 | * | * | 0.164 | 0.017 | 0.0025 | 0.004 | * |
| comparative steel | 224 | * | * | 0 | 0.721 | * | * | 0.721 | 0.019 | 0.0027 | 0.003 | * |
| invented steel | 225 | 1.723 | * | 1.723 | 0.719 | * | 0.005 | 0.720 | 0.019 | 0.0026 | 0.005 | * |

TABLE 10

| | | Machinability | | Charpy impact value (J/cm2) | | Anisotropy | | TICS area ratio | Remarks |
|---|---|---|---|---|---|---|---|---|---|
| Discrimination | No | SA | HT | L direction | T direction | T/L | Ti/S | (%) | (Standard steel) |
| conventional steel | 201 | 1 | 1 | 32.4 | 17.8 | 0.55 | * | 0 | SKS11 |
| comparative steel | 202 | 18.2 | 21.5 | 27.6 | 6.6 | 0.24 | * | 0 | A |
| comparative steel | 203 | 1.4 | 1.6 | 28.4 | 12.5 | 0.44 | 3.88 | 0.08 | low TICS |
| invented steel | 204 | 27.4 | 29.1 | 27.9 | 10.6 | 0.38 | 2.04 | 1.51 | A |
| invented steel | 205 | 38.2 | 28.7 | 28.6 | 11.2 | 0.39 | 2.14 | 1.66 | A |
| comparative steel | 206 | 41.4 | 39.2 | 26.8 | 6.4 | 0.24 | * | 7.84 | B |
| invented steel | 207 | 39.5 | 38.7 | 25.9 | 9.5 | 0.37 | 3.08 | 7.64 | B |
| comparative steel | 208 | 42.1 | 40.4 | 20.8 | 7.5 | 0.36 | 2.96 | 11.30 | high TICS |
| invented steel | 209 | 26.8 | 29.3 | 24.9 | 9.8 | 0.39 | 3.11 | 4.04 | D |
| invented steel | 210 | 51.2 | 42.6 | 27.3 | 10.5 | 0.38 | 3.31 | 2.01 | E |
| conventional steel | 211 | 1 | 1 | 25.7 | 13.9 | 0.54 | * | 0 | SK3 |
| comparative steel | 212 | 19.4 | 19.7 | 24.8 | 6.8 | 0.27 | * | 0 | A |
| invented steel | 213 | 19.2 | 18.9 | 25.1 | 9.8 | 0.39 | 3.39 | 2.38 | A |
| comparative steel | 214 | 31.4 | 29.3 | 27.2 | 7.8 | 0.29 | * | 0 | B |

TABLE 10-continued

| Discrimination | No | Machinability SA | Machinability HT | Charpy impact value (J/cm2) L direction | Charpy impact value (J/cm2) T direction | Anisotropy T/L | Anisotropy Ti/S | TICS area ratio (%) | Remarks (Standard steel) |
|---|---|---|---|---|---|---|---|---|---|
| invented steel | 215 | 38.1 | 36.9 | 28.4 | 11.6 | 0.41 | 3.17 | 6.34 | B |
| conventional steel | 216 | 1 | 1 | 32.8 | 17.3 | 0.53 | * | 0 | SKS4 |
| comparative steel | 217 | 28.5 | 29.6 | 29.4 | 8.3 | 0.28 | * | 0 | A |
| invented steel | 218 | 27.6 | 26.9 | 31.2 | 12.8 | 0.41 | 3.56 | 2.12 | A |
| comparative steel | 219 | 37.2 | 37.1 | 32.9 | 8.9 | 0.27 | * | 6.75 | B |
| invented steel | 220 | 38.6 | 38.2 | 35.8 | 13.2 | 0.37 | 2.55 | 6.87 | B |
| conventional steel | 221 | 1 | 1 | 36.8 | 27.2 | 0.74 | * | 0 | SKS51 |
| comparative steel | 222 | 25.4 | 26.3 | 35.1 | 19.8 | 0.56 | * | 0 | A |
| invented steel | 223 | 28.7 | 23.7 | 32.6 | 23.4 | 0.72 | 2.33 | 1.63 | A |
| comparative steel | 224 | 52.6 | 51.8 | 31.8 | 10.9 | 0.34 | * | 7.23 | B |
| invented steel | 225 | 46.7 | 52.5 | 31.4 | 16.8 | 0.54 | 2.4 | 7.29 | B |

As is clear from the results, of the alloys having the same base composition, those satisfying the composition of the present invention are more excellent in the machinability both in the annealed and quenched-and-tempered states, and smaller in the difference between Charpy impact values between the T-direction and L-direction, which indicates improvement in the anisotropy.

Example 4

As exemplary alloys having the foregoing composition (4), various alloys listed in Tables 11 and 12 (classification of base compositions were given in the remarks column of Table 13) were melted and individually molded into an ingot similarly to Example 1. The obtained ingot was hot-forged similarly to Example 1, and obtained steel strip was further annealed. From such annealed steel strip, base materials for producing Charpy impact test pieces and machinability test pieces were individually cut out similarly to Example 1, except that Charpy impact test pieces were such that having 10-mm R notch in place of the foregoing No. 3 test pieces. One of the base material for producing the test pieces for the machinability test was finished on the surface thereof, to thereby produce an annealed machinability test piece. Next, each one of the base materials for producing Charpy impact test pieces and for machinability test pieces was subjected to quench-and-temper according to predetermined conditions specified by the individual base compositions shown in Table 1, and then surface-finished to thereby finally obtain test pieces for Charpy impact test and quenched-and-tempered machinability test. These test pieces were subjected to Rockwell C-scale hardness test, Charpy impact test and machinability test similarly to Example 1. The surface of the test piece after Charpy impact test was mirror-polished, and the polished surface was subjected to SEM observation and EPMA surface analysis, to thereby determine ratio of area where TICS was formed. An X-ray analysis revealed that the TICS was mainly composed of the foregoing $M_4Q_2C_2$ compound phase. Results were shown in Table 13.

TABLE 11

| Discrimination | No | Chemical component ①(wt %) C | Si | Mn | P | Cu | Ni | Cr | Mo | W | Mo + 0.5W | V | Co |
|---|---|---|---|---|---|---|---|---|---|---|---|---|---|
| conventional steel | 301 | 1.02 | 0.31 | 0.67 | 0.009 | 0.05 | 0.15 | 5.01 | 1.1 | * | * | 0.35 | 0.02 |
| comparative steel | 302 | 1.05 | 0.31 | 0.71 | 0.009 | 0.05 | 0.15 | 5.11 | 1.18 | * | * | 0.39 | * |
| invented steel | 303 | 1.02 | 0.09 | 0.88 | 0.009 | 0.05 | 0.15 | 5.32 | 1.1 | * | * | 0.41 | * |
| invented steel | 304 | 1.00 | 0.32 | 0.85 | 0.009 | 0.05 | 0.15 | 5.27 | 0.89 | 0.62 | 1.2 | 0.35 | * |
| conventional steel | 305 | 1.01 | 0.98 | 0.33 | 0.022 | 0.02 | 0.04 | 8.21 | 2.09 | * | * | 0.28 | * |
| comparative steel | 306 | 1.02 | 0.88 | 0.35 | 0.023 | 0.02 | 0.03 | 8.01 | 2.17 | * | * | 0.34 | * |
| comparative steel | 307 | 1.01 | 0.89 | 0.27 | 0.022 | 0.03 | 0.02 | 8.33 | 1.98 | * | * | 0.31 | 0.03 |
| invented steel | 308 | 1.05 | 0.83 | 0.35 | 0.022 | 0.02 | 0.08 | 8.91 | 2.00 | * | * | 0.25 | * |
| comparative steel | 309 | 1.02 | 0.92 | 0.32 | 0.021 | 0.05 | 0.05 | 8.65 | 2.19 | * | * | 0.27 | * |
| invented steel | 310 | 1.04 | 0.98 | 0.35 | 0.021 | 0.04 | 0.02 | 8.73 | 1.97 | * | * | 0.27 | * |
| conventional steel | 311 | 1.49 | 0.33 | 0.45 | 0.016 | 0.08 | 0.01 | 12.11 | 1.14 | * | * | 0.42 | * |
| comparative steel | 312 | 1.48 | 0.08 | 0.45 | 0.016 | 0.09 | 0.08 | 11.66 | 0.88 | * | * | 0.42 | * |
| comparative steel | 313 | 1.49 | 0.23 | 0.46 | 0.011 | 0.02 | 0.03 | 12.0 | 0.96 | * | * | 0.33 | * |
| invented steel | 314 | 1.53 | 0.33 | 0.43 | 0.016 | 0.08 | 0.09 | 12.89 | 1.09 | * | * | 0.29 | * |
| comparative steel | 315 | 1.50 | 0.29 | 0.42 | 0.015 | 0.05 | 0.05 | 11.6 | 1.07 | * | * | 1.07 | * |
| invented steel | 316 | 1.55 | 0.30 | 0.46 | 0.016 | 0.08 | 0.44 | 11.41 | 1.02 | * | * | 0.38 | * |
| conventional steel | 317 | 2.29 | 0.44 | 0.33 | 0.022 | 0.05 | 0.06 | 13.44 | 1.03 | 0.02 | 1.04 | 0.05 | * |
| comparative steel | 318 | 2.32 | 0.38 | 0.66 | 0.021 | 0.09 | 0.1 | 12.89 | 0.79 | 0.01 | 0.80 | 0.06 | * |
| invented steel | 319 | 2.35 | 0.32 | 0.45 | 0.016 | 0.07 | 0.01 | 13.21 | 1.14 | * | * | 0.03 | * |

TABLE 12

| Discrimination | No | Chemical component ②(wt %) | | | | | | | | | | |
|---|---|---|---|---|---|---|---|---|---|---|---|---|
| | | Ti | Zr | Ti + 0.52Zr | S | Se | Te | S + 0.4Se + 0.25Te | S—Al | O | N | Others |
| conventional steel | 301 | * | * | * | 0.001 | * | * | 0.001 | 0.015 | 0.0013 | 0.017 | * |
| comparative steel | 302 | * | * | * | 0.13 | * | * | 0.13 | 0.014 | 0.0016 | 0.018 | * |
| invented steel | 303 | 0.41 | * | 0.41 | 0.15 | * | * | 0.15 | 0.011 | 0.0018 | 0.022 | * |
| invented steel | 304 | 0.39 | 0.3 | 0.55 | 0.14 | * | * | 0.14 | 0.013 | 0.0015 | 0.15 | * |
| conventional steel | 305 | * | * | * | 0.001 | * | * | 0.001 | 0.003 | 0.0026 | 0.008 | * |
| comparative steel | 306 | * | * | * | 0.15 | * | * | 0.15 | 0.002 | 0.0028 | 0.009 | * |
| comparative steel | 307 | 0.01 | * | 0.01 | 0.11 | * | * | 0.11 | 0.004 | 0.0025 | 0.009 | * |
| invented steel | 308 | 0.24 | * | 0.24 | 0.08 | 0.18 | * | 0.15 | 0.001 | 0.0027 | 0.009 | * |
| comparative steel | 309 | * | * | * | 0.35 | * | * | 0.35 | 0.003 | 0.0025 | 0.009 | * |
| invented steel | 310 | 0.82 | * | 0.82 | 0.31 | * | * | 0.31 | 0.001 | 0.0028 | 0.01 | * |
| conventional steel | 311 | * | * | * | 0.001 | * | * | 0.001 | 0.002 | 0.0023 | 0.016 | * |
| comparative steel | 312 | * | * | * | 0.09 | * | * | 0.12 | 0.003 | 0.0022 | 0.017 | * |
| comparative steel | 313 | 4.65 | * | 4.65 | 0.49 | * | * | 0.49 | 0.004 | 0.0021 | 0.011 | * |
| invented steel | 314 | 0.32 | 0.08 | 0.36 | 0.100 | 0.05 | 0.05 | 0.13 | 0.002 | 0.0020 | 0.015 | Ca = 0.0011<br>Pb = 0.15<br>Bi = 0.05<br>Nb = 0.006<br>Ta = 0.011<br>REM = 0.10 |
| comparative steel | 315 | * | * | * | 0.25 | * | * | 0.25 | 0.003 | 0.0022 | 0.014 | * |
| invented steel | 316 | 0.69 | * | 0.69 | 0.22 | 0.03 | 0.14 | 0.267 | 0.001 | 0.0020 | 0.015 | * |
| conventional steel | 317 | * | * | * | 0.002 | * | * | 0.002 | 0.008 | 0.0012 | 0.008 | * |
| comparative steel | 318 | * | * | * | 0.13 | * | * | 0.13 | 0.009 | 0.0016 | 0.009 | * |
| invented steel | 319 | 0.48 | * | 0.48 | 0.16 | * | * | 0.15 | 0.007 | 0.0014 | 0.010 | * |

TABLE 13

| Discrimination | No | Machinability | | Charpy impact value (J/cm2) | | | | TICS area ratio | Remarks |
|---|---|---|---|---|---|---|---|---|---|
| | | SA | HT | L direction | T direction | T/L | Ti/S | (%) | (Standard steel) |
| conventional steel | 301 | 1 | 1 | 51 | 35 | 0.69 | * | 0 | SKD12 |
| comparative steel | 302 | 65 | 103 | 40 | 15 | 0.38 | * | 0 | A |
| invented steel | 303 | 70 | 106 | 41 | 23 | 0.56 | 2.7 | 1.33 | A |
| invented steel | 304 | 65 | 100 | 43 | 22 | 0.51 | 3.9 | 1.41 | A |
| conventional steel | 305 | 1 | 1 | 51 | 26 | 0.51 | * | 0 | 8% Cr-series steel |
| comparative steel | 306 | 42 | 78 | 23 | 5 | 0.22 | * | 0 | A |
| comparative steel | 307 | 39 | 75 | 25 | 7 | 0.28 | 0.09 | 1.09 | low TICS |
| invented steel | 308 | 41 | 73 | 26 | 11 | 0.42 | 1.6 | 1.48 | A |
| comparative steel | 309 | 54 | 105 | 19 | 4 | 0.21 | * | 0 | B |
| invented steel | 310 | 52 | 109 | 18 | 6 | 0.33 | 2.6 | 3.6 | B |
| conventional steel | 311 | 1 | 1 | 45 | 32 | 0.71 | * | 0 | SKD11 |
| comparative steel | 312 | 60 | 92 | 39 | 15 | 0.38 | * | 0 | A |
| comparative steel | 313 | 140 | 150 | 10 | 3 | 0.30 | 9.5 | 4.65 | high Ti |
| invented steel | 314 | 92 | 98 | 38 | 22 | 0.58 | 2.8 | 1.12 | A |
| comparative steel | 315 | 107 | 125 | 20 | 5 | 0.25 | * | 0 | B |
| invented steel | 316 | 105 | 120 | 21 | 11 | 0.52 | 2.6 | 2.61 | B |
| conventional steel | 317 | 1 | 1 | 23 | 14 | 0.61 | * | 0 | SKD1 |
| comparative steel | 318 | 78 | 107 | 15 | 6 | 0.40 | * | 0 | A |
| invented steel | 319 | 88 | 130 | 20 | 10 | 0.50 | 3.2 | 1.75 | A |

As is clear from the results, of the alloys having the same base composition, those satisfying the composition of the present invention are more excellent in the machinability both in the annealed and quenched-and-tempered states, and smaller in the difference between Charpy impact values between the T-direction and L-direction, which indicates improvement in the anisotropy.

EXAMPLE 5

As exemplary alloys having the foregoing composition (5), various alloys listed in Tables 14 and 15 (classification of base compositions were given in the remarks column of Table 16) were melted and individually molded into an ingot similarly to Example 1. The obtained ingot was hot-forged similarly to Example 1, and obtained steel strip was further annealed. From such annealed steel strip, base materials for producing test pieces for anti-breakage test (size: 3 mm×5 mm×35 mm) and for producing test pieces for machinability test as described in Example 1 were individually cut out. The test pieces for anti-breakage test were produced in a paired manner, where one of which is a test piece having the long edge in the forging-and-rolling direction (L-directional test piece), and the other of which is a test piece having the long edge in the thickness direction (T-directional test piece). One of the test pieces for the machinability test was finished on the surface thereof, to thereby produce an annealed machinability test piece. Next, each one of the base materials for producing anti-breakage test pieces and for machinability test pieces was subjected to quench-and-temper according to predetermined conditions specified by the individual base compositions shown in Table 1, and then surface-finished to thereby finally obtain test pieces for anti-breakage test and quenched-and-tempered machinability test. These test pieces were subjected to Rockwell C-scale hardness test and machinability test similarly to Example 1. On the other hand, the anti-breakage test pieces were subjected to three-point bending anti-breakage test at a span length of 30 mm, and a ratio of anti-breakage strength PT/PL (T/L) was determined, where PT is an anti-breakage strength observed for the T-directional test piece and PL is an anti-breakage strength obtained for the L-directional test piece. The surface of the test piece after the anti-breakage test was mirror-polished, and the polished surface was subjected to SEM observation and EPMA surface analysis, to thereby determine ratio of area where TICS was formed. An X-ray analysis revealed that the TICS was mainly composed of the foregoing $M_4Q_2C_2$ compound phase. Results were shown in Table 16.

TABLE 14

| | | Chemical component ①(wt %) | | | | | | | | | | | |
|---|---|---|---|---|---|---|---|---|---|---|---|---|---|
| Discrimination | No | C | Si | Mn | P | Cu | Ni | Cr | Mo | W | Mo + 0.5W | V | Co |
| conventional steel | 401 | 0.85 | 0.38 | 0.34 | 0.015 | 0.08 | 0.05 | 4.04 | 5.01 | 5.95 | 7.99 | 1.87 | 0.02 |
| comparative steel | 402 | 0.87 | 0.35 | 0.63 | 0.006 | 0.03 | 0.9 | 4.14 | 5.11 | 5.89 | 8.06 | 1.78 | 0.09 |
| comparative steel | 403 | 0.81 | 0.42 | 0.12 | 0.002 | 0.23 | 0.23 | 3.89 | 4.83 | 6.02 | 7.84 | 1.73 | 0.012 |
| invented steel | 404 | 0.91 | 0.41 | 0.32 | 0.002 | 0.13 | 0.43 | 4.01 | 4.97 | 6.03 | 7.99 | 1.76 | 0.02 |
| invented steel | 405 | 0.89 | 0.05 | 0.48 | 0.013 | 0.07 | 0.03 | 4.58 | 5.13 | 6.21 | 8.24 | 1.85 | 0.02 |
| comparative steel | 406 | 0.78 | 0.45 | 0.13 | 0.002 | 0.25 | 0.24 | 3.93 | 4.85 | 5.99 | 7.85 | 1.69 | 0.01 |
| invented steel | 407 | 0.81 | 0.42 | 0.12 | 0.002 | 0.23 | 0.23 | 3.89 | 4.83 | 6.02 | 7.84 | 1.73 | 0.012 |
| comparative steel | 408 | 0.95 | 0.02 | 1.25 | 0.002 | 0.25 | 0.24 | 4.35 | 4.85 | 5.81 | 7.76 | 1.75 | 0.01 |
| invented steel | 409 | 0.94 | 0.03 | 1.23 | 0.002 | 0.23 | 0.23 | 4.21 | 4.83 | 5.79 | 7.73 | 1.73 | 0.012 |
| comparative steel | 410 | 0.89 | 0.34 | 0.12 | 0.002 | 0.23 | 0.23 | 3.89 | 4.83 | 6.02 | 7.84 | 1.73 | 0.012 |
| conventional steel | 411 | 1.45 | 0.33 | 0.25 | 0.009 | 0.05 | 0.15 | 4.33 | 0.15 | 12.33 | 6.32 | 4.55 | 4.89 |
| comparative steel | 412 | 1.48 | 0.22 | 0.79 | 0.013 | 0.03 | 0.22 | 4.21 | 0.18 | 12.95 | 6.66 | 4.35 | 5.02 |
| invented steel | 413 | 1.55 | 0.46 | 0.13 | 0.002 | 0.09 | 0.98 | 3.15 | 0.22 | 14.22 | 7.33 | 4.83 | 5.47 |
| invented steel | 414 | 1.73 | 0.33 | 0.32 | 0.018 | 0.02 | 0.01 | 4.15 | 4.55 | 14.3 | 11.70 | 3.12 | 7.85 |
| conventional steel | 415 | 1.13 | 0.38 | 0.27 | 0.028 | 0.03 | 0.04 | 4.25 | 9.55 | 1.52 | 10.31 | 1.23 | 8.65 |
| comparative steel | 416 | 1.15 | 0.06 | 0.78 | 0.012 | 0.02 | 0.06 | 4.55 | 9.23 | 1.99 | 10.23 | 1.19 | 8.02 |
| invented steel | 417 | 1.24 | 0.45 | 0.56 | 0.012 | 0.01 | 0.05 | 6.89 | 8.02 | 4.53 | 10.29 | 1.45 | 10.03 |
| comparative steel | 418 | 1.30 | 0.75 | 0.38 | 0.005 | 0.15 | 0.24 | 6.28 | 7.47 | 6.92 | 10.93 | 1.27 | 11.1 |
| invented steel | 419 | 1.34 | 0.78 | 0.39 | 0.004 | 0.12 | 0.22 | 6.14 | 7.28 | 6.98 | 10.77 | 1.23 | 11.48 |
| conventional steel | 420 | 0.56 | 0.07 | 0.35 | 0.0012 | 0.03 | 0.04 | 4.56 | 3.71 | 1.72 | 4.57 | 0.97 | 0.07 |
| comparative steel | 421 | 0.57 | 0.06 | 0.37 | 0.012 | 0.02 | 0.06 | 4.55 | 3.69 | 1.73 | 4.56 | 0.92 | 0.09 |
| invented steel | 422 | 0.58 | 0.06 | 0.29 | 0.011 | 0.05 | 0.11 | 4.63 | 3.65 | 1.69 | 4.50 | 0.87 | 0.11 |
| comparative steel | 423 | 0.55 | 0.35 | 1.25 | 0.004 | 0.02 | 0.06 | 4.72 | 3.58 | 1.75 | 4.46 | 0.92 | 0.17 |
| invented steel | 424 | 0.59 | 0.34 | 1.24 | 0.002 | 0.01 | 0.05 | 4.77 | 3.68 | 1.75 | 4.56 | 0.93 | 0.14 |

TABLE 15

| | | Chemical component ②(wt %) | | | | | | | | | | |
|---|---|---|---|---|---|---|---|---|---|---|---|---|
| Discrimination | No | Ti | Zr | Ti + 0.52Zr | S | Se | Te | S + 0.4Se + 0.25Te | S—Al | O | N | Others |
| conventional steel | 401 | * | * | * | 0.001 | * | * | 0.001 | 0.019 | 0.002 | 0.013 | * |
| comparative steel | 402 | * | * | * | 0.132 | * | * | 0.132 | 0.020 | 0.003 | 0.012 | * |
| comparative steel | 403 | 0.0342 | 0.03 | 0.05 | 0.009 | * | * | 0.009 | 0.018 | 0.001 | 0.009 | * |
| invented steel | 404 | 0.38 | * | 0.38 | 0.135 | * | * | 0.135 | 0.018 | 0.003 | 0.011 | * |
| invented steel | 405 | 0.242 | * | 0.51 | 0.121 | 0.04 | * | 0.137 | 0.017 | 0.001 | 0.015 | Ca = 0.0031<br>Pb = 0.02<br>Bi = 0.03<br>Nb = 0.01<br>Ta = 0.012<br>REM = 0.0032 |
| comparative steel | 406 | * | * | * | 0.401 | * | * | 0.401 | 0.017 | 0.001 | 0.008 | * |
| invented steel | 407 | 1.34895 | 0.03 | 1.365 | 0.391 | * | 0.03 | 0.399 | 0.019 | 0.001 | 0.009 | * |
| comparative steel | 408 | * | * | * | 0.791 | * | * | 0.791 | 0.018 | 0.001 | 0.007 | * |
| invented steel | 409 | 2.53555 | 0.03 | 2.551 | 0.785 | * | 0.03 | 0.793 | 0.020 | 0.001 | 0.009 | * |
| comparative steel | 410 | 3.7354 | 0.03 | 3.751 | 0.983 | * | 0.03 | 0.991 | 0.019 | 0.001 | 0.009 | * |
| conventional steel | 411 | * | * | * | 0.001 | * | * | 0.001 | 0.012 | 0.0016 | 0.018 | * |
| comparative steel | 412 | * | * | * | 0.23 | * | * | 0.23 | 0.011 | 0.004 | 0.015 | * |
| invented steel | 413 | 0.7035 | 0.03 | 0.719 | 0.21 | * | * | 0.21 | 0.100 | 0.007 | 0.019 | * |
| invented steel | 414 | 0.48384 | 0.01 | 0.489 | 0.256 | * | 0.003 | 0.257 | 0.012 | 0.002 | 0.005 | * |
| conventional steel | 415 | * | * | * | 0.001 | * | * | 0.001 | 0.023 | 0.002 | 0.022 | * |
| comparative steel | 416 | * | * | * | 0.115 | 0.15 | 0.009 | 0.177 | 0.022 | 0.009 | 0.011 | * |
| invented steel | 417 | 0.45 | * | 0.45 | 0.172 | * | * | 0.172 | 0.023 | 0.011 | 0.016 | * |
| comparative steel | 418 | * | * | * | 2.75 | * | * | 2.75 | 0.022 | 0.003 | 0.008 | * |
| invented steel | 419 | 0.39 | 0.09 | 0.437 | 0.25 | 0.05 | 0.01 | 0.273 | 0.022 | 0.002 | 0.006 | * |
| conventional steel | 420 | * | * | * | 0.001 | * | * | 0.001 | 0.008 | 0.002 | 0.022 | * |
| comparative steel | 421 | * | * | * | 0.093 | 0.04 | 0.04 | 0.119 | 0.009 | 0.009 | 0.011 | * |
| invented steel | 422 | 0.303 | 0.13 | 0.371 | 0.101 | 0.01 | 0.05 | 0.118 | 0.007 | 0.002 | 0.013 | * |
| comparative steel | 423 | * | * | * | 0.222 | * | * | 0.222 | 0.009 | 0.013 | 0.016 | * |
| invented steel | 424 | 0.32494 | 0.01 | 0.33 | 0.211 | * | 0.002 | 0.212 | 0.008 | 0.011 | 0.016 | * |

TABLE 16

| Discrimination | No | Machinability SA | Machinability HT | Anti-breakage strength (MPa) L direction | Anti-breakage strength (MPa) T direction | Anisotropy T/L | Anisotropy Ti/S | TICS area ratio (%) | Remarks (Standard steel) |
|---|---|---|---|---|---|---|---|---|---|
| conventional steel | 401 | 1 | 1 | 4210 | 2270 | 0.53 | * | 0 | SKH51 |
| comparative steel | 402 | 2 | 2.4 | 3780 | 790 | 0.21 | * | 0 | A |
| comparative steel | 403 | 1.5 | 1.7 | 4090 | 1850 | 0.45 | 5.6 | 0.07 | low TICS |
| invented steel | 404 | 2.1 | 2.6 | 3890 | 1362 | 0.350128535 | 2.8 | 1.37 | A |
| invented steel | 405 | 2.5 | 3.3 | 3710 | 1360 | 0.37 | 3.7 | 1.33 | A |
| comparative steel | 406 | 3.5 | 3.9 | 3200 | 640 | 0.20 | * | 0 | B |
| invented steel | 407 | 3.5 | 4.0 | 3170 | 1050 | 0.33 | 3.4 | 3.92 | B |
| comparative steel | 408 | 6.2 | 7.3 | 3000 | 540 | 0.18 | * | 0 | C |
| invented steel | 409 | 6 | 7.5 | 3070 | 920 | 0.30 | 3.2 | 8.01 | C |
| comparative steel | 410 | 9 | 11 | 2990 | 860 | 0.29 | 3.8 | 11.81 | high TICS |
| conventional steel | 411 | 1 | 1 | 3280 | 1640 | 0.50 | * | 0 | SKH10 |
| comparative steel | 412 | 2.3 | 2.8 | 2890 | 600 | 0.21 | * | 0 | A |
| invented steel | 413 | 2.4 | 2.7 | 2990 | 1050 | 0.35 | 3.4 | 2.16 | A |
| invented steel | 414 | 2.6 | 3.1 | 2760 | 860 | 0.31 | 1.9 | 2.27 | A |
| conventional steel | 415 | 1 | 1 | 3650 | 1750 | 0.48 | * | 0 | SKH58 |
| comparative steel | 416 | 2.5 | 3 | 3430 | 720 | 0.21 | * | 0 | A |
| invented steel | 417 | 2.6 | 3.1 | 3580 | 1146 | 0.32 | 2.6 | 1.72 | A |
| comparative steel | 418 | 3.5 | 4.1 | 3190 | 620 | 0.19 | * | 0.0 | B |
| invented steel | 419 | 3.3 | 3.9 | 3270 | 1014 | 0.31 | 1.6 | 2.73 | B |
| conventional steel | 420 | 1 | 1 | 5830 | 3032 | 0.520068611 | * | 0 | matrix high-speed steel |
| comparative steel | 421 | 1.6 | 1.9 | 5650 | 1413 | 0.25 | * | 0 | A |
| invented steel | 422 | 1.5 | 1.8 | 5720 | 2230 | 0.38986014 | 3.1 | 1.18 | A |
| comparative steel | 423 | 2.4 | 2.5 | 5190 | 1120 | 0.21 | * | 0.0 | B |
| invented steel | 424 | 2.2 | 2.6 | 5280 | 1790 | 0.33 | 1.6 | 2.12 | B |

As is clear from the results, of the alloys having the same base composition, those satisfying the composition of the present invention are more excellent in the machinability both in the annealed and quenched-and-tempered states, and smaller in the difference between Charpy impact values between the T-direction and L-direction, which indicates improvement in the anisotropy.

The following experiments were carried out to confirm effects of the free-cutting tool steel according to the second aspect of the present invention.

EXAMPLE 6

Each of the invented steels and comparative steels having chemical compositions listed in Table 17, in a form of 150-kg steel ingot, was melted in a high-frequency induction heater, kept at 1,200° C., and then processed by hot forging into a 60 mm×60 mm square bar. The rod was then heated to either appropriate temperature of 870° C., 900° C. and 935° C. for 100 minutes so as to attain a surface hardness (C-scale Rockwell hardness) of HRC 40±3, cooled by air blasting (solution treatment), heated for 5 hours at either appropriate temperature of 500° C., 520° C. and 540° C., and then cooled (age precipitation hardening).

TABLE 17

| | | Chemical component (wt %) C | Si | Mn | P | Cu | Ni | Cr | Mo | Al | N | O |
|---|---|---|---|---|---|---|---|---|---|---|---|---|
| invented steel | 1 | 0.034 | 0.04 | 1.42 | 0.02 | 1.54 | 2.87 | 9.84 | 0.51 | 1.91 | 0.0094 | 0.0288 |
| | 2 | 0.391 | 0.27 | 0.02 | 0.01 | 0.78 | 4.87 | 4.01 | 0.34 | 0.14 | 0.0023 | 0.0015 |
| | 3 | 0.113 | 1.89 | 0.01 | 0.02 | 2.56 | 0.45 | 5.88 | 0.49 | 2.88 | 0.0022 | 0.0013 |
| | 4 | 0.145 | 0.42 | 0.94 | 0.01 | 0.76 | 1.39 | 2.19 | 2.79 | 0.56 | 0.0034 | 0.0056 |
| | 5 | 0.144 | 0.08 | 0.32 | 0.01 | 0.29 | 3.41 | 0.94 | 0.24 | 1.06 | 0.0067 | 0.0275 |
| | 6 | 0.121 | 0.31 | 1.48 | 0.01 | 1.08 | 3.28 | 0.28 | 0.32 | 1.01 | 0.0015 | 0.0012 |
| | 7 | 0.003 | 0.17 | 2.82 | 0.02 | 1.55 | 3.31 | 0.13 | 0.54 | 1.05 | 0.0122 | 0.0293 |
| | 8 | 0.017 | 0.21 | 0.45 | 0.01 | 1.67 | 2.67 | 8.71 | 0.54 | 0.57 | 0.0015 | 0.0244 |
| | 9 | 0.228 | 0.08 | 0.87 | 0.02 | 1.09 | 3.91 | 3.56 | 0.31 | 0.03 | 0.0044 | 0.021 |
| | 10 | 0.21 | 0.88 | 0.01 | 0.01 | 4.78 | 4.65 | 3.85 | 0.39 | 1.97 | 0.0035 | 0.0008 |
| | 11 | 0.233 | 1.02 | 0.43 | 0.01 | 1.38 | 0.12 | 5.92 | 2.87 | 0.64 | 0.0008 | 0.0021 |
| | 12 | 0.376 | 0.95 | 1.54 | 0.02 | 1.25 | 0.71 | 2.83 | 1.53 | 0.71 | 0.0019 | 0.0039 |
| | 13 | 0.138 | 0.32 | 0.65 | 0.01 | 0.89 | 1.76 | 8.94 | 1.045 | 1.34 | 0.0086 | 0.0134 |
| | 14 | 0.012 | 0.31 | 2.89 | 0.02 | 0.09 | 2.64 | 9.64 | 0.03 | 1.12 | 0.0079 | 0.0251 |
| | 15 | 0.008 | 0.12 | 0.21 | 0.02 | 0.34 | 2.91 | 0.87 | 0.01 | 1.04 | 0.0087 | 0.0281 |
| | 16 | 0.25 | 0.33 | 1.07 | 0.01 | 0.76 | 3.33 | 0.23 | 0.11 | 0.94 | 0.0071 | 0.0092 |
| | 17 | 0.045 | 1.03 | 0.45 | 0.02 | 1.55 | 2.84 | 5.88 | 2.66 | 0.94 | 0.0089 | 0.0056 |
| comparative steel | 1 | 0.11 | 0.3 | 1.53 | 0.01 | 0.97 | 3.34 | 0.25 | 0.25 | 1.11 | 0.0115 | 0.0065 |
| | 2 | 0.023 | 1.53 | 1.03 | 0.02 | 1.45 | 3.41 | 0.23 | 0.32 | 0.53 | 0.0091 | 0.0032 |
| | 3 | 0.132 | 0.55 | 0.63 | 0.01 | 1.67 | 3.04 | 0.55 | 0.03 | 0.88 | 0.0043 | 0.0045 |
| | 4 | 0.121 | 0.27 | 1.56 | 0.01 | 1.04 | 3.41 | 0.34 | 0.34 | 1.04 | 0.0021 | 0.0014 |
| | 5 | 0.45 | 0.34 | 0.71 | 0.01 | 0.78 | 2.59 | 0.25 | 0.33 | 0.76 | 0.0055 | 0.0021 |
| | 6 | 0.221 | 0.55 | 1.86 | 0.02 | 0.84 | 3.09 | 0.16 | 0.49 | 0.96 | 0.0081 | 0.0085 |
| | 7 | 0.133 | 0.21 | 1.01 | 0.01 | 1.63 | 2.57 | 3.32 | 0.21 | 0.84 | 0.0082 | 0.0013 |
| | 8 | 0.097 | 0.11 | 0.55 | 0.02 | 1.22 | 3.23 | 7.55 | 1.77 | 1.23 | 0.0037 | 0.0008 |

TABLE 17-continued

| | | Chemical component (wt %) | | | | | | | | | | |
|---|---|---|---|---|---|---|---|---|---|---|---|---|
| | | S | Se | Te | Y | Ti | Zr | V | X | W | Co | Nb |
| invented steel | 1 | 0.05 | 0.05 | | 0.07 | 0.09 | 0.02 | | 0.1004 | | | |
| | 2 | 0.309 | | | 0.309 | 0.45 | | 0.13 | 0.5722 | 0.12 | | |
| | 3 | 0.28 | | 0.04 | 0.29 | 0.35 | | | 0.35 | | | 0.004 |
| | 4 | 0.978 | | | 0.978 | 0.98 | | | 0.98 | | 0.005 | |
| | 5 | 0.288 | | | 0.288 | 0.42 | | | 0.42 | | | |
| | 6 | 0.104 | | | 0.104 | 0.32 | | | 0.32 | | | |
| | 7 | 0.011 | | | 0.011 | 0.03 | | | 0.03 | | | |
| | 8 | 0.042 | | | 0.042 | 0.07 | | | 0.07 | 0.81 | | |
| | 9 | 0.321 | | | 0.321 | 0.43 | 0.42 | | 0.6484 | | | |
| | 10 | 0.32 | | | 0.32 | 0.87 | | | 0.87 | | 0.42 | |
| | 11 | 0.67 | | | 0.67 | 2.43 | | | 2.43 | | | 0.84 |
| | 12 | 0.932 | 0.45 | | 1.112 | 2.05 | | 1.13 | 3.1122 | | | |
| | 13 | 0.35 | 0.06 | 0.25 | 0.4365 | 1.04 | | | 1.04 | | 0.03 | 0.02 |
| | 14 | 0.012 | | | 0.012 | 0.05 | | | 0.05 | | | |
| | 15 | 0.02 | | | 0.02 | 0.04 | | | 0.04 | | | |
| | 16 | 0.781 | 0.38 | | 0.933 | 2.88 | | 0.49 | 3.4 | | | |
| | 17 | 0.145 | | | 0.145 | 0.032 | | | 0.032 | | | |
| comparative steel | 1 | — | | | — | — | | | — | | | |
| | 2 | — | | | — | 0.004 | | | 0.004 | | | |
| | 3 | 0.13 | | | 0.13 | — | | | — | | | |
| | 4 | 0.098 | | | 0.098 | — | | | — | | | |
| | 5 | — | | | — | — | | | — | | | |
| | 6 | 0.882 | 0.39 | 0.25 | 1.1 | — | | | — | | | |
| | 7 | — | | | — | 2.15 | | 1.54 | 3.6 | | | |
| | 8 | — | | | — | 0.02 | | | 0.02 | | | |

It was found that a major inclusion in the steel of the present invention was a compound expressed as (Ti, Zr, V)$_4$(S, Se, Te)$_2$C$_2$, and that MnS was also observed together therewith for (Ti, Zr, V)-base sulfides such as (Ti, Zr, V)S, (Ti, Zr, V)S$_3$ and (Ti, Zr, V)$_{0.81}$S; (Ti, Zr, V)-base carbides such as (Ti, Zr, V)C; and those containing a relatively large amount of Mn.

The inclusion was identified as described below.

Figure 2A:
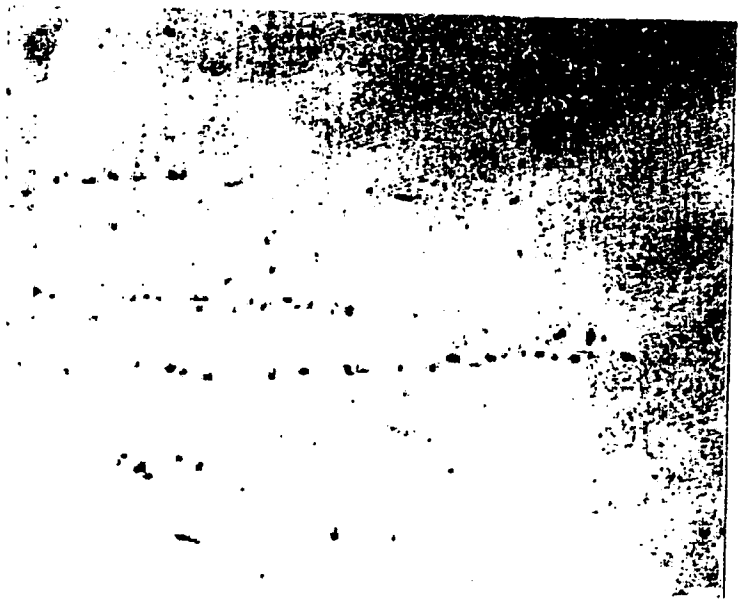
FIGS. 2A and 2B are observed images under an optical microscope of polished sectional planes of the invented steel No. 6 and comparative steel No. 4, respectively.
Figure 2B:
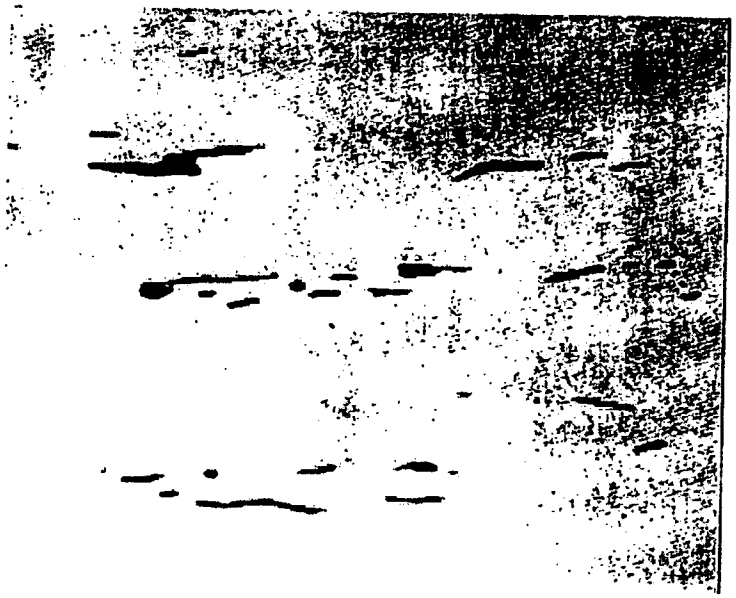

A proper volume of test piece was cut out from the individual square bar, and the metal matrix portion thereof was electrolyzed using as an electrolyte a methanol solution containing tetramethylammonium chloride and 10% of acetylacetone. The electrolytic solution after the dissolution was filtered, insoluble compounds contained in the tool steel was extracted, dried, and analyzed by X-ray diffractometry. The compound was identified based on peaks appeared in the diffraction profile. FIG. 1 shows an X-ray diffraction profile of invented steel No. 6, and FIGS. 2A and 2B are observed images under an optical microscope (400× magnification) of polished sectional planes of the invented steel No. 6 and comparative steel No. 4, respectively. The comparative steel No. 4 has formed therein MnS which is responsible for improving the machinability. The observed image of the invented steel No. 6 shows the free-cutting property exhibiting compound phase having an approximately spherical shape. On the contrary, the observed image of the comparative steel No. 4 shows MnS grains elongated along the forging-and-rolling direction.

Composition of the compound grain in the steel texture was separately examined by the EPMA analysis. Based on a two-dimensional mapping, it was confirmed that a compound having a composition corresponded to that of the compound identified in the X-ray diffractometry had been formed. It was also confirmed from the EPMA analysis of the polished sectional plane of the invented steel No. 12, which has a relatively large V content, that the compound insoluble to the electrolytic solution contained, as metal element components, also V together with Ti as a major component.

The foregoing individual test pieces were examined by the following experiments.

1. Machinability Test

Machinability was evaluated based on the amount of wear of the tool when the test piece was cut. A double-blade-type, high-speed-steel end mill having a diameter of 10 mm was used as a machining tool, and average wear width ($V_{bave}$ (mm)) of the lateral flank of the end mill tool was measured when the dry cutting was carried out with a cutting depth of 5 mm, cutting speed of 25 mm/min, amount of feed of sample material of 0.02 mm/blade, and cutting length of 4,000 mm. All steel materials composing the sample material were annealed to thereby adjust the C-scale Rockwell hardness of within HRC 40±3. The measured wear amount was judged as desirable if it is suppressed to 80% or below as compared to that of the comparative steel No. 1, having contained therein no machinability improving element, nor formed therein no machinability improving compound phase.

2. Evaluation of Toughness

Toughness was evaluated by Charpy impact test (described in JIS Z2242). The test pieces used herein were so-called 2-mm, U-notched test pieces (No. 3 test piece described in JIS Z 2202), which were produced by cutting the square bar along the T direction and L direction. A ratio of Charpy impact values $I_T/I_L$ (T/L) was then determined, where $I_T$ is a Charpy impact value of a T-directional test piece having the notching direction parallel to the forging-and-rolling direction, and $I_L$ is a Charpy impact value of an L-directional test piece having the notching direction normal thereto. The machinability test was then carried out using the annealed test piece (SA) and quenched-and-tempered test piece (HT) according to the conditions described below. All test pieces were previously subjected to the annealing so as to adjust the C-scale Rockwell hardness thereof within HRC 40±3. $I_T/I_L$ (T/L) was expressed in comparison with that of the comparative steel No. 4 using MnS, where a larger value represents a smaller degradation of the T-directional toughness. Results were shown in Table 18.

TABLE 18

| | | Results of Experiments | | | | |
|---|---|---|---|---|---|---|
| | | Formula A | Formula B | Area ratio of Ti-base carbosulfide (%) | Wear amount of tool Vbave (mm) | T/L ratio (T-directional impact value/L-directional impact value: J/cm2) |
| invented steel | 1 | ○ | X | 0.89 | 0.329 | 0.36 (3.6/12.0) |
| | 2 | ○ | X | 3.5 | 0.245 | 0.36 (6.0/16.7) |
| | 3 | ○ | X | 0.15 | 0.298 | 0.37 (3.9/10.6) |
| | 4 | ○ | X | 9.75 | 0.208 | 0.33 (3.6/11.0) |
| | 5 | ○ | X | 2.91 | 0.221 | 0.37 (3.4/9.3) |
| | 6 | ○ | ○ | 1.2 | 0.155 | 0.45 (5.7/12.7) |
| | 7 | ○ | ○ | 0.97 | 0.187 | 0.41 (6.6/16.1) |
| | 8 | ○ | ○ | 0.45 | 0.211 | 0.49 (8.0/16.3) |
| | 9 | ○ | ○ | 3.3 | 0.209 | 0.38 (4.6/12.2) |
| | 10 | ○ | ○ | 0.19 | 0.241 | 0.42 (8.7/20.6) |
| | 11 | ○ | ○ | 0.23 | 0.245 | 0.44 (5.6/12.8) |
| | 12 | ○ | ○ | 8.73 | 0.115 | 0.37 (3.6/9.8) |
| | 13 | ○ | ○ | 5.81 | 0.114 | 0.37 (3.8/10.2) |
| | 14 | ○ | ○ | 0.16 | 0.255 | 0.46 (9.2/20.1) |
| | 15 | ○ | ○ | 4.88 | 0.139 | 0.35 (4.9/13.9) |
| | 16 | X | X | 10.5 | 0.474 | 0.22 (2.8/12.7) |
| | 17 | X | X | 0.03 | 0.392 | 0.27 (4.2/15.5) |
| comparative steel | 1 | X | X | — | 0.632 | 0.56 (7.8/14.0) |
| | 2 | X | X | — | 0.662 | 0.52 (10.4/20.1) |
| | 3 | X | X | — | 0.233 | 0.21 (2.5/12.1) |
| | 4 | X | X | — | 0.239 | 0.26 (2.4/9.3) |
| | 5 | X | X | — | 0.753 | 0.72 (12.1/16.8) |
| | 6 | X | X | — | 0.132 | 0.18 (1.8/10.0) |
| | 7 | X | X | — | 0.691 | 0.52 (7.3/14.0) |
| | 8 | X | X | — | 0.611 | 0.67 (8.2/12.2) |

It was found from Table 18 that the comparative steel No. 2 having added therein no machinability improving element showed the machinability almost equivalent to that of the comparative steel No. 1. On the contrary, the invented steels and the comparative steels Nos. 3 and 4 having added therein the conventional machinability improving elements showed the wear amount suppressed to as low as 80% or below, which indicates improvement in the machinability. The comparative steels Nos. 3 and 4 using MnS, however, showed a ratio $I_T/I_L$ of Charpy impact values of less than 0.3, which indicates a considerable degradation of the toughness in the T direction. Invented steels were excellent in the machinability, and had an $I_T/I_L$ value of 0.3 or above, which indicates that degradation of the toughness was successfully suppressed. The invented steels Nos. 1 to 5 satisfying the condition A were more excellent in the machinability than the invented steels Nos. 16 and 17 not satisfying such condition A. It was also found that the invented steels Nos. 6 to 15 additionally satisfying the condition B were still more excellent in the machinability than the invented steels Nos. 1 to 5 satisfying the condition A only.

EXAMPLE 7

One-hundred-and-fifty-kilogram steel ingots of the invented steels and comparative steels having chemical components listed in Tables 19/20 (Group A), Tables 22/23 (Group B) and Tables 25/26 (Group C) were melted in a high-frequency induction heater, forged and annealed as described in Example 1. From the annealed materials, test pieces for evaluating machinability (same as Example 1), for evaluating toughness (Charpy impact) (same as Example 1), for evaluating mirror surface smoothness (square plate of 60 mm long, 55 mm wide and 15 mm thick), and for being subjected to the brine spray test (square plate of 55 mm long, 80 mm wide and 1 mm thick).

TABLE 19

| | C | Si | Mn | P | Cu | Ni | Cr | Mo | W | V | Co | Nb | Al | Others | N | O |
|---|---|---|---|---|---|---|---|---|---|---|---|---|---|---|---|---|
| 1 conventional steel | 0.23 | 0.15 | 0.84 | 0.013 | * | 0.55 | 13.55 | 0.24 | * | * | * | * | 0.012 | * | 0.0166 | 0.0061 |
| 2 comparative steel | 0.28 | 0.33 | 0.83 | 0.015 | * | 0.42 | 12.65 | 0.45 | * | * | * | * | 0.003 | * | 0.0342 | 0.0053 |
| 3 comparative steel | 0.55 | 0.44 | 1.45 | 0.051 | 0.66 | 8.44 | 22.92 | 0.32 | 0.56 | 0.04 | * | * | 0.34 | * | 0.0245 | 0.0151 |
| 4 comparative steel | 0.22 | 0.24 | 0.88 | 0.032 | * | 0.41 | 12.55 | 0.35 | * | 0.51 | * | * | 0.003 | * | 0.0089 | 0.0371 |
| 5 comparative steel | 1.03 | 0.11 | 0.11 | 0.021 | 0.23 | * | 15.49 | 1.55 | * | * | * | * | 0.003 | * | 0.0031 | 0.0322 |
| 6 invented steel | 0.35 | 0.31 | 0.81 | 0.020 | 0.05 | 0.54 | 21.89 | 0.74 | * | * | * | * | 0.005 | * | 0.0202 | 0.0032 |
| 7 invented steel | 0.28 | 0.01 | 0.34 | 0.035 | 0.02 | 0.31 | 13.99 | 0.23 | * | 0.01 | * | 0.02 | 0.004 | * | 0.0076 | 0.0066 |
| 8 invented steel | 0.29 | 0.14 | 0.01 | 0.010 | 0.01 | 0.29 | 12.81 | 0.44 | * | 0.34 | * | * | 0.001 | * | 0.0071 | 0.0013 |
| 9 invented steel | 0.39 | 0.13 | 0.99 | 0.011 | 0.06 | 0.01 | 13.72 | 0.13 | 0.01 | 0.41 | 0.41 | * | 0.015 | * | 0.0153 | 0.0296 |
| 10 invented steel | 0.004 | 0.40 | 0.87 | 0.015 | 0.11 | 0.54 | 17.91 | 0.01 | 0.32 | 0.33 | 1.93 | * | 2.88 | * | 0.0133 | 0.0264 |
| 11 invented steel | 0.59 | 1.43 | 1.52 | 0.025 | 4.98 | 5.91 | 10.23 | 0.45 | 0.35 | 0.98 | 0.01 | * | 0.022 | REM = 0.13 | 0.0390 | 0.0255 |
| 12 invented steel | 0.41 | 1.99 | 1.41 | 0.038 | 1.10 | 0.51 | 12.88 | 3.89 | 0.02 | * | * | * | 0.011 | Ta = 0.033 | 0.0281 | 0.0067 |
| 13 invented steel | 0.44 | 0.66 | 2.98 | 0.015 | 0.03 | 0.62 | 13.13 | 0.44 | 5.82 | * | * | 0.93 | 0.013 | B = 0.0025<br>Ca = 0.0023<br>Pb = 0.02<br>Bi = 0.15 | 0.0319 | 0.0091 |

TABLE 20

| | Ti | Zr | X | S | Se | Te | Y | X/Y | Judgment |
|---|---|---|---|---|---|---|---|---|---|
| 1 conventional steel | * | * | * | * | * | * | * | * | X |
| 2 comparative steel | * | * | * | 0.12 | * | * | 0.12 | * | X |
| 3 comparative steel | * | * | * | 0.23 | 0.22 | 0.19 | 0.3655 | * | X |
| 4 comparative steel | * | * | * | 0.04 | * | * | 0.04 | * | X |
| 5 comparative steel | * | * | * | 0.87 | * | * | 0.87 | * | X |
| 6 invented steel | 0.02 | * | 0.02 | 0.108 | * | * | 0.108 | 0.19 | X |
| 7 invented steel | 0.31 | 0.44 | 0.54 | 0.221 | * | * | 0.221 | 2.44 | ○ |
| 8 invented steel | 0.45 | 0.12 | 0.51 | 0.135 | * | * | 0.135 | 3.80 | ○ |
| 9 invented steel | 0.91 | * | 0.91 | 0.682 | 0.23 | 0.12 | 0.804 | 1.13 | ○ |
| 10 invented steel | 0.035 | * | 0.035 | 0.021 | * | * | 0.021 | 1.67 | ○ |
| 11 invented steel | 0.32 | * | 0.32 | 0.122 | * | * | 0.122 | 2.62 | ○ |
| 12 invented steel | 0.29 | * | 0.29 | 0.097 | * | 0.06 | 0.112 | 2.59 | ○ |
| 13 invented steel | 0.41 | * | 0.41 | 0.114 | 0.04 | * | 0.13 | 3.15 | ○ |

TABLE 21

| | TICS area | Relative cutting length | | Charpy impact value (J/CM2) | | T/L | Surface roughness (μm) | Outer appearance after | Length of inclusion of 50 μm or |
|---|---|---|---|---|---|---|---|---|---|
| | ratio | SA | HT | L direction | T direction | ratio | Ra | corrosion | below |
| 1 conventional steel | * | 1 | 1 | 62 | 52 | 0.84 | 1.85 | C | ○ |
| 2 comparative steel | * | 23.4 | 31.1 | 51 | 9 | 0.18 | 18.9 | C | X |
| 3 comparative steel | * | 15.4 | 16.5 | 39 | 5 | 0.13 | 19.4 | C | X |
| 4 comparative steel | * | 9.5 | 10.9 | 65 | 11 | 0.17 | 17.5 | C | X |
| 5 comparative steel | * | 31.0 | 32.8 | 29 | 4 | 0.14 | 31.5 | D | X |
| 6 invented steel | 0.06 | 1.46 | 3.55 | 55 | 47 | 0.8 | 2.22 | B | ○ |
| 7 invented steel | 2.3 | 18.9 | 29.1 | 49 | 21 | 0.43 | 2.68 | B | ○ |
| 8 invented steel | 1.44 | 15.5 | 20.5 | 69 | 32 | 0.46 | 3.21 | A | ○ |
| 9 invented steel | 8.13 | 25.4 | 36.2 | 36 | 12 | 0.33 | 0.91 | B | ○ |
| 10 invented steel | 0.3 | 5.33 | 6.99 | 66 | 57 | 0.86 | 1.55 | A | ○ |
| 11 invented steel | 1.31 | 19.2 | 19.1 | 59 | 43 | 0.73 | 1.99 | A | ○ |
| 12 invented steel | 1.21 | 15.3 | 16.8 | 53 | 29 | 0.55 | 2.11 | A | ○ |
| 13 invented steel | 1.39 | 14.5 | 12.2 | 53 | 28 | 0.53 | 4.22 | B | ○ |

TABLE 22

| | C | Si | Mn | P | Cu | Ni | Cr | Mo | W | V | Co | Nb | Al | Others | N | O |
|---|---|---|---|---|---|---|---|---|---|---|---|---|---|---|---|---|
| 14 conventional steel | 0.28 | 0.34 | 0.75 | 0.023 | * | 0.51 | 12.80 | * | * | * | * | * | 0.015 | | 0.0144 | 0.0075 |
| 15 comparative steel | 0.36 | 1.04 | 0.38 | 0.016 | 0.04 | 0.20 | 13.36 | 0.09 | 0.01 | 0.27 | 0.024 | 0.010 | 0.010 | | 0.0156 | 0.0028 |
| 16 comparative steel | 1.05 | 0.25 | 0.89 | 0.015 | * | 0.22 | 12.22 | 0.11 | 0.03 | 0.29 | 0.021 | * | 0.022 | | 0.0083 | 0.0012 |
| 17 comparative steel | 0.22 | 0.33 | 0.79 | 0.021 | * | 0.16 | 13.34 | 0.36 | 0.02 | 0.31 | * | 0.21 | 0.043 | | 0.0461 | 0.0266 |
| 18 comparative steel | 0.34 | 0.13 | 0.32 | 0.034 | 0.87 | 0.55 | 23.11 | 0.41 | 0.23 | 0.27 | * | 0.10 | 2.51 | | 0.0154 | 0.0091 |
| 19 invented steel | 0.32 | 0.44 | 1.69 | 0.017 | 1.09 | 0.24 | 13.14 | 0.01 | 0.33 | 0.98 | 0.011 | 0.20 | 2.94 | | 0.0241 | 0.0154 |
| 20 invented steel | 0.43 | 1.89 | 2.89 | 0.017 | 1.23 | 0.81 | 14.99 | 0.06 | 0.15 | 0.31 | 0.24 | 0.25 | 0.89 | | 0.0188 | 0.0122 |
| 21 invented steel | 0.35 | 0.32 | 1.55 | 0.011 | 4.91 | 0.30 | 13.22 | 0.32 | 0.01 | 0.26 | 0.44 | 0.24 | 0.94 | | 0.0042 | 0.0004 |
| 22 invented steel | 0.32 | 0.45 | 1.45 | 0.023 | 0.03 | 0.21 | 21.94 | 0.37 | 0.85 | 0.21 | 1.87 | 0.19 | 1.04 | | 0.0059 | 0.0052 |
| 23 invented steel | 0.002 | 0.09 | 0.81 | 0.021 | 0.02 | 0.98 | 14.52 | 0.12 | 0.87 | 0.34 | 1.04 | 0.98 | 0.34 | | 0.0051 | 0.0042 |
| 24 invented steel | 0.45 | 0.25 | 0.79 | 0.014 | 0.01 | 5.88 | 14.28 | 0.38 | 0.04 | * | * | * | 0.021 | REM = 0.39 | 0.0091 | 0.0012 |
| 25 invented steel | 0.59 | 0.35 | 0.34 | 0.028 | 0.06 | 3.22 | 13.98 | * | 0.15 | 0.01 | 0.54 | 0.29 | 0.015 | Ca = 0.0012 | 0.0392 | 0.0295 |
| 26 invented steel | 0.33 | 0.33 | 0.45 | 0.020 | 0.12 | 2.34 | 0.03 | 3.22 | 0.29 | 0.35 | 0.58 | 0.27 | 0.002 | B = 0.0023<br>Pb = 0.17<br>Ta = 0.011<br>Bi = 0.19 | 0.0005 | 0.0010 |

TABLE 23

| | Ti | Zr | X | S | Se | Te | Y | X/Y | Judgment |
|---|---|---|---|---|---|---|---|---|---|
| 14 conventional steel | * | * | * | * | * | * | * | * | X |
| 15 comparative steel | * | * | * | 0.01 | * | * | 0.01 | * | X |
| 16 comparative steel | * | * | * | 0.06 | * | * | 0.06 | * | X |
| 17 comparative steel | * | * | * | 0.04 | 0.01 | * | 0.044 | * | X |
| 18 comparative steel | * | * | * | 0.15 | * | 0.04 | 0.16 | * | X |
| 19 invented steel | 0.05 | * | 0.05 | 0.004 | * | * | 0.004 | 12.50 | X |
| 20 invented steel | 0.15 | * | 0.15 | 0.052 | * | * | 0.052 | 2.88 | ○ |
| 21 invented steel | 0.08 | 0.11 | 0.14 | 0.042 | * | * | 0.042 | 3.27 | ○ |
| 22 invented steel | 0.32 | 0.11 | 0.38 | 0.085 | * | 0.05 | 0.0975 | 3.87 | ○ |

TABLE 23-continued

| | Ti | Zr | X | S | Se | Te | Y | X/Y | Judgment |
|---|---|---|---|---|---|---|---|---|---|
| 23 invented steel | 1.02 | * | 1.02 | 0.122 | 0.11 | 0.54 | 0.301 | 3.39 | ○ |
| 24 invented steel | 0.54 | * | 0.54 | 0.285 | * | * | 0.285 | 1.89 | ○ |
| 25 invented steel | 2.63 | 0.22 | 2.74 | 0.92 | * | * | 0.92 | 2.98 | ○ |
| 26 invented steel | 0.23 | * | 0.23 | 0.105 | * | 0.01 | 0.1075 | 2.14 | ○ |

TABLE 24

| | TICS area | Relative cutting length | | Charpy impact value (J/CM2) | | T/L | Surface roughness (μm) | Outer appearance after | Length of inclusion of 50 μm or |
|---|---|---|---|---|---|---|---|---|---|
| | ratio | SA | HT | L direction | T direction | ratio | Ra | corrosion | below |
| 14 conventional steel | * | 1 | 1 | 30 | 28 | 0.93 | 0.42 | C | ○ |
| 15 comparative steel | * | 10.4 | 12.5 | 25 | 4 | 0.16 | 10.4 | C | X |
| 16 comparative steel | * | 15.2 | 18.3 | 23 | 5 | 0.22 | 12.2 | C | X |
| 17 comparative steel | * | 14.5 | 16.2 | 28 | 3 | 0.11 | 11.2 | C | X |
| 18 comparative steel | * | 20.5 | 22.1 | 22 | 4 | 0.18 | 15.5 | D | X |
| 19 invented steel | 0.13 | 3.51 | 5.62 | 31 | 22 | 0.71 | 1.22 | C | ○ |
| 20 invented steel | 0.61 | 9.45 | 10.44 | 35 | 21 | 0.60 | 0.45 | A | ○ |
| 21 invented steel | 0.51 | 8.55 | 7.55 | 23 | 11 | 0.48 | 0.82 | A | ○ |
| 22 invented steel | 1.07 | 10.5 | 10.2 | 24 | 15 | 0.63 | 0.69 | B | ○ |
| 23 invented steel | 3.10 | 24.2 | 25.6 | 19 | 10 | 0.53 | 1.22 | B | ○ |
| 24 invented steel | 2.94 | 22.1 | 29.1 | 29 | 17 | 0.59 | 2.31 | B | ○ |
| 25 invented steel | 9.29 | 35.6 | 40.5 | 18 | 11 | 0.61 | 4.29 | B | ○ |
| 26 invented steel | 1.17 | 10.5 | 20.4 | 25 | 13 | 0.52 | 1.02 | D | ○ |

TABLE 25

| | C | Si | Mn | P | Cu | Ni | Cr | Mo | W | V | Co | Nb | Al | Others | N | O |
|---|---|---|---|---|---|---|---|---|---|---|---|---|---|---|---|---|
| 27 conventional steel | 0.033 | 0.76 | 0.81 | 0.021 | 3.65 | 3.81 | 16.22 | * | * | * | * | 0.24 | 0.012 | | 0.0252 | 0.0122 |
| 28 comparative steel | 0.028 | 0.76 | 0.77 | 0.017 | 1.48 | 5.24 | 13.05 | 2.98 | * | * | 1.00 | * | 0.019 | | 0.0189 | 0.0030 |
| 29 comparative steel | 0.026 | 0.39 | 0.89 | 0.022 | 1.90 | 5.21 | 12.22 | * | * | 1.51 | * | * | 0.023 | | 0.0244 | 0.0032 |
| 30 comparative steel | 0.014 | 0.12 | 0.37 | 0.039 | 3.32 | 3.91 | 25.05 | * | 1.61 | * | * | 0.32 | 0.012 | | 0.0092 | 0.0134 |
| 31 comparative steel | 1.23 | 0.31 | 0.37 | 0.022 | 3.15 | 3.18 | 13.31 | 3.11 | * | * | 0.13 | * | 0.009 | | 0.0121 | 0.0113 |
| 32 invented steel | 0.033 | 0.91 | 0.25 | 0.012 | 1.50 | 5.49 | 13.10 | 0.02 | 0.02 | 0.02 | 1.99 | 0.31 | 0.001 | | 0.0182 | 0.0012 |
| 33 invented steel | 0.135 | 0.53 | 0.29 | 0.025 | 1.71 | 5.21 | 14.21 | 0.91 | 5.12 | 0.31 | 0.03 | * | 2.96 | | 0.0381 | 0.0061 |
| 34 invented steel | 0.045 | 1.98 | 0.61 | 0.009 | 4.95 | 5.49 | 21.92 | 1.55 | 0.03 | 0.44 | 0.01 | 0.13 | 1.03 | | 0.0012 | 0.0133 |
| 35 invented steel | 0.066 | 0.01 | 0.87 | 0.014 | 0.02 | 5.92 | 14.50 | 3.14 | 0.02 | 0.25 | 0.55 | 0.01 | 1.22 | | 0.0043 | 0.0285 |
| 36 invented steel | 0.081 | 0.03 | 0.82 | 0.015 | 1.67 | 0.02 | 10.05 | 3.91 | * | 0.98 | * | 0.02 | 0.041 | | 0.0089 | 0.0123 |
| 37 invented steel | 0.072 | 0.13 | 0.79 | 0.014 | 1.61 | 3.22 | 14.31 | 3.21 | 0.02 | 0.12 | 1.32 | 0.43 | 0.021 | REM = 0.48 | 0.0141 | 0.0098 |
| 38 invented steel | 0.082 | 0.04 | 2.93 | 0.022 | 1.79 | 3.51 | 12.96 | 3.66 | 0.54 | * | 1.06 | 0.95 | 0.026 | Pb = 0.12 | 0.0196 | 0.0031 |
| 39 invented steel | 0.112 | 0.91 | 0.01 | 0.022 | 1.52 | 4.81 | 17.86 | 3.71 | 0.22 | 0.23 | 1.31 | 0.31 | 0.031 | Ca = 0.0032<br>B = 0.0015<br>Ta = 0.003<br>Bi = 0.03 | 0.0188 | 0.0026 |

TABLE 26

| | Ti | Zr | X | S | Se | Te | Y | X/Y | Judgment |
|---|---|---|---|---|---|---|---|---|---|
| 27 conventional steel | * | * | * | * | * | * | * | * | X |
| 28 comparative steel | * | * | * | 0.077 | * | * | 0.077 | * | X |
| 29 comparative steel | * | * | * | 0.134 | * | * | 0.134 | * | X |
| 30 comparative steel | * | * | * | 0.195 | * | 0.02 | 0.2 | * | X |
| 31 comparative steel | * | * | * | 0.032 | 0.16 | * | 0.096 | * | X |
| 32 invented steel | 0.02 | * | 0.02 | 0.033 | * | * | 0.033 | 0.61 | X |

TABLE 26-continued

| | Ti | Zr | X | S | Se | Te | Y | X/Y | Judgment |
|---|---|---|---|---|---|---|---|---|---|
| 33 invented steel | 0.13 | 0.32 | 0.30 | 0.09 | 0.21 | * | 0.174 | 1.70 | ○ |
| 34 invented steel | 0.09 | 2.51 | 1.40 | 0.43 | * | * | 0.43 | 3.24 | ○ |
| 35 invented steel | 0.32 | 0.02 | 0.33 | 0.11 | * | * | 0.11 | 3.00 | ○ |
| 36 invented steel | 0.23 | * | 0.23 | 0.002 | 0.22 | * | 0.09 | 2.56 | ○ |
| 37 invented steel | 0.11 | * | 0.11 | 0.05 | * | * | 0.05 | 2.20 | ○ |
| 38 invented steel | 3.32 | * | 3.23 | 0.89 | 0.51 | 0.44 | 1.204 | 2.68 | ○ |
| 39 invented steel | 0.91 | 0.41 | 1.12 | 0.31 | * | 0.32 | 0.39 | 2.88 | ○ |

TABLE 27

| | TICS area | Relative cutting length | | Charpy impact value (J/CM2) | | T/L | Surface roughness (μm) | Outer appearance after | Length of inclusion of 50 μm or |
|---|---|---|---|---|---|---|---|---|---|
| | ratio | SA | HT | L direction | T direction | ratio | Ra | corrosion | below |
| 27 conventional steel | * | 1 | 1 | 65 | 42 | 0.65 | 0.33 | C | ○ |
| 28 comparative steel | * | 64.0 | 77.3 | 34 | 8 | 0.24 | 3.32 | C | X |
| 29 comparative steel | * | 83.3 | 72.2 | 31 | 4 | 0.13 | 5.21 | C | X |
| 30 comparative steel | * | 95.1 | 68.2 | 35 | 7 | 0.20 | 6.98 | D | X |
| 31 comparative steel | * | 65.2 | 75.2 | 23 | 5 | 0.22 | 3.56 | C | X |
| 32 invented steel | 0.42 | 19.4 | 20.6 | 43 | 29 | 0.67 | 0.67 | A | ○ |
| 33 invented steel | 1.83 | 55.2 | 66.9 | 51 | 30 | 0.59 | 0.98 | A | ○ |
| 34 invented steel | 4.39 | 99.3 | 87.0 | 45 | 21 | 0.47 | 0.35 | B | ○ |
| 35 invented steel | 1.19 | 84.5 | 94.2 | 44 | 25 | 0.57 | 0.76 | A | ○ |
| 36 invented steel | 0.99 | 75.1 | 62.3 | 39 | 19 | 0.49 | 0.51 | A | ○ |
| 37 invented steel | 0.59 | 42.3 | 86.9 | 61 | 38 | 0.62 | 0.30 | A | ○ |
| 38 invented steel | 9.71 | 59.5 | 43.3 | 31 | 18 | 0.58 | 0.59 | B | ○ |
| 39 invented steel | 3.99 | 87.4 | 69.8 | 49 | 17 | 0.35 | 0.42 | A | ○ |

The test pieces were then subjected to the individual evaluation test described below.

1. Machinability Test

Two types of machinability test pieces were used, where one of which was obtained by subjecting thus processed test pieces again to the annealing, which is referred to as annealed machinability test piece (SA), and the other was obtained by heat treatment for hardening according to the conditions specified for the individual groups of steel materials listed in Table 28, which is referred to as heat-treated (HT) machinability test piece. The machinability was evaluated based on the wear amount of the tool used for the cutting. That is, a double-bladed, high-speed-steel end mill having a diameter of 10 mm was used as a machining tool, and the machinability was evaluated based on the cutting length causative of 0.3 mm of average wear width ($V_{bave}$ (mm)) of the lateral flank of the end mill tool when the dry cutting was carried out with a cutting depth of 5 mm, cutting speed of 25 mm/min, and amount of feed of sample material of 0.02 mm/blade. The cutting length was expressed relative to that of the conventional steel having added thereto no cutting property improving element, nor having added therein no machinability improving compound phase. Results were shown in Tables 21, 24 and 27 in relative values.

2. Evaluation of Toughness

The test pieces subjected to the heat treatment for hardening listed in Table 22 were examined by Charpy impact test similarly to Example 1. Results were shown in Tables 21, 24 and 27.

3. Evaluation of Mirror Surface Smoothness

The test pieces were mirror-polished by mechanical polishing using diamond grindstones, while sequentially raising the fineness of such grindstones as #150→#400→#800→#1,500 →#3,000. Mirror surface smoothness was obtained in compliance with the method specified by JIS B0601 (1994), in which surface roughness was measured at five points arbitrarily selected on the polished surface with a reference length of 15 mm, and an arithmetic average roughness $R_a$ was obtained as an average of the roughness values observed at such 5 points. Results were shown in Tables 21, 24 and 27.

4. Brine Spray Test

The test was carried out in compliance with JIS Z2371 (1994). The corrosion resistance after the test was evaluated based on a ratio of corroded area, and expressed as follows. A: not corroded, B: corroded but only less than 5%, C: 5% to 20%, both ends inclusive, and D: more than 20%. Results were shown in Tables 21, 24 and 27.

As being totally judged from the above results, the steel of the present invention was found to be excellent in all of

TABLE 28

| | Quenching condition | Tempering condition | Hardness after solution treatment | Hardness after hardening treatment |
|---|---|---|---|---|
| Group A | 1050° C. × 1 Hr → oil cooling | 500° C. × 6 Hr → air cooling · twice | HRC35 | HRC50 |
| Group B | 1030° C. × 1 Hr → oil cooling | 500° C. × 4 Hr → air cooling · twice | HRC32 | HRC53 |
| | conditions for solid solution treatment | conditions for age hardening | SA hardness | ST-AG hardness |
| Group C | 970° C. × 1 Hr → air cooling | 610° C. × 5 Hr → air cooling · once | HRC20 | HRC40 |

the machinability, toughness (in particular, directional independence) and mirror surface smoothness as compared with those of the free-cutting steels (denoted as "comparative steel" in the Tables) which are not included within the scope of the present invention. It was also made clear that addition of a proper amount of Cr is advantageous in ensuring excellent corrosion resistance as proven by the brine spray test.

What is claimed is:

1. A free-cutting tool steel containing Fe as a major component and C in an amount of 0.2 to 0.6 wt %;

containing Ti and/or Zr so that $W_{Ti}+0.52W_{Zr}$ amounts to 0.03 to 3.5 wt %, where $W_{Ti}$ represents Ti content (wt %) and $W_{zr}$ represents Zr content (wt %);

containing at least any one of S, Se and Te so that $W_S+0.4W_{Se}+0.25W_{Te}$ amounts to 0.01 to 1.0 wt %, and so that $(W_{Ti}+0.52W_{Zr})/(W_S+0.4W_{Se}+0.25\ W_{Te})$ amounts to 1 to 4, where $W_S$ represents S content (wt %), $W_{Se}$ represents Se content (wt %) and $W_{Te}$ represents Te content (wt %);

having dispersed in a texture thereof a machinability improving compound phase within a range from 0.1 to 10% in terms of area ratio in a section;

said machinability improving compound phase comprising a metallic element component having Ti and/or Zr as major components, and a binding component for such metallic element component essentially containing C and also containing at least any one of S, Se and Te; and essentially containing Cr in an amount of 4.24 to 7 wt %; and containing at least any one element selected from Mn in an amount of 2.0 wt % or less, Ni in an amount of 2.5 wt % or less, Mo and/or W so that Mo+0.5W amounts to 4.0 wt % or less, V in an amount of 2 wt % or less, and Co in an amount of 5.0 wt % or less.

2. The free-cutting tool steel according to claim 1, wherein said machinability improving compound phase mainly comprises a component phase expressed by a composition formula $M_4Q_2C_2$ (where M represents the metallic element component mainly comprises Ti and/or Zr, and Q represents at least any one of S, Se and Te).

3. The free-cutting tool steel according to claim 1, wherein Si amount is 2.0 wt % or less, Al amount is 0.1 wt % or less and N amount is 0.040 wt % or less.

4. The free-cutting tool steel according to claim 1, further containing at least any one element selected from Ca in an amount of 0.0050 wt % or less, Pb in an amount of 0.2 wt % or less, Bi in an amount of 0.2 wt % or less, B in an amount of 0.010 wt % or less, Nb and/or Ta so that Nb+0.5Ta amounts to 0.05 wt % or less, and a rare earth metal in an amount of 0.50 wt % or less.

5. The free-cutting tool steel according to claim 1, used as a source material for hot forming die.

6. A free-cutting tool steel containing Fe as a major component and C in an amount of 0.5 to 2.5 wt %;

containing Ti and/or Zr so that $W_{Ti}+0.52\ W_{Zr}$ amounts to 0.03 to 3.5 wt %, where $W_{Ti}$ represents Ti content (wt %) and $W_{Zr}$ represents Zr content (wt %);

containing at least any one of S, Se and Te so that $W_S+0.4W_{Se}+0.25W_{Te}$ amounts to 0.01 to 1.0 wt %, and so that $(W_{Ti}+0.52W_{Zr})/(W_S+0.4W_{Se}+0.25W_{Te})$ amounts to 1 to 4, where $W_S$ represents S content (wt %), $W_{Se}$ represents Se content (wt %) and $W_{Te}$ represents Te content (wt %);

having dispersed in a texture thereof a machinability improving compound phase within a range from 0.1 to 10% in terms of area ratio in a section;

said machinability improving compound phase comprising a metallic element component having Ti and/or Zr as major components, and a binding component for such metallic element component essentially containing C and also containing at least any one of S, Se and Te;

essentially containing Cr in an amount of 4 to 17 wt %; and containing at least any one element selected from Mn in an amount of 2.0 wt % or less, Ni in an amount of 1.0 wt % or less, Mo and/or W so that Mo+0.5W amounts to 1.5 wt % or less, V in an amount of 1 wt % or less, and Co in an amount of 1.0 wt % or less.

7. The free-cutting tool steel according to claim 6 used as a source material for cold forming die.

8. A free-cutting tool steel containing Fe as a major component and C in an amount of 0.5 to 2.0 wt %;

containing Ti and/or Zr so that $W_{Ti}+0.52W_{Zr}$ amounts to 0.03 to 3.5 wt %, where $W_{Ti}$ represents Ti content (wt %) and $W_{Zr}$ represents Zr content (wt %);

containing at least any one of S, Se and Te so that $W_S0.4W_{Se}+0.25W_{Te}$ amounts to 0.01 to 1.0 wt %, and so that $(W_{Ti}+0.52W_{Zr})/(W_S+0.4W_{Se}+0.25W_{Te})$ amounts to 1 to 4, where $W_S$ represents S content (wt %), $W_{Se}$ represents Se content (wt %) and $W_{Te}$ represents Te content (wt %);

having dispersed in a texture thereof a machinability improving compound phase within a range from 0.1 to 10% in terms of area ratio in a section;

said machinability improving compound phase comprising a metallic element component having Ti and/or Zr as major components, and a binding component for such metallic element component essentially containing C and also containing at least any one of S, Se and Te; and containing at least any three elements selected from Cr as an essential element in an amount of 3 to 7 wt %, Mo and/or W as an essential element so that Mo+0.5W amounts to 4 to 12 wt %, V as an essential element in an amount of 0.5 to 6.0 wt %, Mn in an amount of 2.0 wt % or less, Ni in an amount of 1.0 wt % or less, and Co in an amount of 15.0 wt % or less.

9. The free-cutting tool steel according to claim 8 used as a source material for cutting tool, cold forming die or hot forming die.

10. A free-cutting tool steel containing Fe as a major component and C in an amount of 0.001 to 0.4 wt %; and further containing Ni in an amount of 1 to 5 wt % Cu in an amount of 0.5 to 5 wt %, Al in an amount of 0.5 to 3 wt %, and Cr in an amount of less than 10 wt %;

wherein such tool steel further contains:

Ti and/or Zr so that X (wt %)=$W_{Ti}+0.52W_{Zr}$ amounts to 0.03 to 3.5 wt %, where $W_{Ti}$ represents Ti content (wt %) and $W_{Zr}$ represents Zr content (wt %);

at least any one of S, Se and Te so that Y (wt %)=$W_S+0.4W_{Se}+0.25W_{Te}$ amounts to 0.01 to 1 wt %, where $W_S$ represents S content (wt %), $W_{Se}$ represents Se content (wt %) and $W_{Te}$ represents Te content (wt %); and having dispersed in a texture thereof a machinability improving compound phase;

said machinability improving compound phase comprising a metallic element component having Ti and/or Zr as major components, and a binding component for such metallic element component essentially containing C and also containing at least any one of S, Se and Te; and the values X and Y are defined so as to satisfy a relation of $1 \leqq X/Y \leqq 4$.

11. The free-cutting tool steel according to claim 10, wherein said machinability improving compound phase mainly comprises a component phase expressed by a composition formula $M_4Q_2C_2$ (where M represents the metallic element component mainly comprises Ti and/or Zr, and Q represents at least any one of S, Se and Te).

12. The free-cutting tool steel according to claim 10 having a ratio of Charpy impact values $I_T/I_L$ of 0.3 or above, where $I_T$ is a Charpy impact value of a T-directional test piece and $I_L$ is a Charpy impact value of an L-directional test piece:

said impact values being obtained in Charpy impact test specified by JIS Z2242; and said T-directional test piece and L-directional test piece being fabricated as No. 3 test pieces specified in JIS Z2202 by notching a forged-and-rolled product of such tool steel along the directions parallel to and normal to the forging-and-rolling direction, respectively.

13. The free-cutting tool steel according to claim 10, wherein said machinability improving compound phase observed in a polished surface of such tool steel has an area ratio of 0.1 to 10%.

14. The free-cutting tool steel according to claim 10 satisfying relations of $0.2X \leqq Y \leqq X$; and $0.07X \leqq W_C \leqq 0.75X$ where $W_C$ represents C content (wt %).

15. The free-cutting tool steel according to claim 10 further containing at least any one element selected from Mo and/or W so that $W_{Mo}+0.5W_W$ amounts to 4 wt % or less, where $W_{Mo}$ represents Mo content (wt %) and $W_W$ represents W content (wt %), Mn in an amount of 3 wt % or less, Co in an amount of 2 wt % or less, Nb in an amount of 1 wt % or less and V in an amount of 1 wt % or less.

16. The free-cutting tool steel according to claim 10 wherein Si amount is 2 wt % or less, N amount is 0.04 wt % or less, and O amount is 0.03 wt % or less.

17. The free-cutting tool steel according to claim 10 further containing at least any one element selected from Ca in an amount of 0.005 wt % or less, Pb in an amount of 0.2 wt % or less, Bi in an amount of 0.2 wt % or less, Ta in an amount of 0.05 wt % or less, B in an amount of 0.01 wt % or less, and a rare earth metal element in an amount of 0.5 wt % or less.

18. The free-cutting tool steel according to claim 10 used as a source material for die for molding plastics.

19. The free-cutting tool steel according to claim 6, wherein said machinability improving compound phase mainly comprises a component phase expressed by a composition formula $M_4Q_2C_2$ (where M represents the metallic element component mainly comprises Ti and/or Zr, and Q represents at least any one of S, Se and Te).

20. The free-cutting tool steel according to claim 6 wherein Si amount is 2.0 wt % or less, Al amount is 0.1 wt % or less and N amount is 0.040 wt % or less.

21. The free-cutting tool steel according to claim 6 further containing at least any one element selected from Ca in an amount of 0.0050 wt % or less, Pb in an amount of 0.2 wt % or less, Bi in an amount of 0.2 wt % or less, B in an amount of 0.010 wt % or less, Nb and/or Ta so that Nb+0.5Ta amounts to 0.05 wt % or less, and a rare earth metal in an amount of 0.50 wt % or less.

22. The free-cutting tool steel according to claim 8, wherein said machinability improving compound phase mainly comprises a component phase expressed by a composition formula $M_4Q_2C_2$ (where M represents the metallic element component mainly comprises Ti and/or Zr, and Q represents at least any one of S, Se and Te).

23. The free-cutting tool steel according to claim 8 wherein Si amount is 2.0 wt % or less, Al amount is 0.1 wt % or less and N amount is 0.040 wt % or less.

24. The free-cutting tool steel according to claim 8 further containing at least any one element selected from Ca in an amount of 0.0050 wt % or less, Pb in an amount of 0.2 wt % or less, Bi in an amount of 0.2 wt % or less, B in an amount of 0.010 wt % or less, Nb and/or Ta so that Nb+0.5Ta amounts to 0.05 wt % or less, and a rare earth metal in an amount of 0.50 wt % or less.

25. A free-cutting tool steel containing Fe as a major component and C in an amount of 0.033 to 0.6 wt %; and further containing Ni in an amount of 6 wt % or less, Cu in an amount of 5 wt % or less, Al in an amount of 3 wt % or less and Cr in an amount of 10 to 22 wt % or less;

wherein such tool steel further contains:

Ti and/or Zr so that X (wt %)=$W_{Ti}+0.52W_{Zr}$ amounts to 0.03 to 3.5 wt %, where $W_{Ti}$ represents Ti content (wt %) and $W_{Zr}$ represents Zr content (wt %);

at least any one of S, Se and Te so that Y (wt %)=$W_S+0.4W_{Se}+0.25\ W_{Te}$ amounts to 0.01 to 1 wt %, where $W_S$ represents S content (wt %), $W_{Se}$ presents Se content (wt %) and $W_{Te}$ represents Te content (wt %); and having dispersed in a texture thereof a machinability improving compound phase;

said machinability improving compound phase comprising a metallic element component having Ti and/or Zr as major components, and a binding component for such metallic element component essentially containing C and also containing at least any one of S, Se and Te; and the values X and Y are defined so as to satisfy a relation of $1 \leqq X/Y \leqq 4$.

26. The free-cutting tool steel according to claim 25, wherein said machinability improving compound phase mainly comprises a component phase expressed by a composition formula $M_4Q_2C_2$ (where M represents the metallic element component mainly comprises Ti and/or Zr, and Q represents at least any one of S, Se and Te).

27. The free-cutting tool steel according to claim 25 having a ratio of Charpy impact values $I_T/I_L$ of 0.3 or above, where $I_T$ is a Charpy impact value of a T-directional test piece and $I_L$ is a Charpy impact value of an L-directional test piece:

said impact values being obtained in Charpy impact test specified by JIS Z2242; and said T-directional test piece and L-directional test piece being fabric ted as No. 3 test pieces specified in JIS Z2202 by notching a forged-and-rolled product of such tool steel along the directions parallel to and normal to the forging-and-rolling direction, respectively.

28. The free-cutting tool steel according to claim 25, wherein said machinability improving compound phase observed in a polished surface of such tool steel has an area ratio of 0.1 to 10%.

29. The free-cutting tool steel according to claim 25 satisfying relations of $0.2X \leqq Y \leqq X$; and $0.07X \leqq W_C \leqq 0.75X$ where $W_C$ represents C content (wt %).

30. The free-cutting tool steel according to claim 25 further containing at least any one element selected from Mo and/or W so that $W_{Mo}+0.5W_W$ amounts to 4 wt % or less, where $W_{Mo}$ represents Mo content (wt %) and $W_W$ represents W content (wt %), Mn in an amount of 3 wt % or less, Co in an amount of 2 wt % or less, Nb in an amount of 1 wt % or less and V in an amount of 1 wt % or less.

31. The free-cutting tool steel according to claim 25 wherein Si amount is 2 wt % or less. N amount is 0.04 wt % or less, and O amount is 0.03 wt % or less.

32. The free-cutting tool steel according to claim 25 further containing at least any one element selected from Ca in an amount of 0.005 wt % or less, Pb in an amount of 0.2 wt % or less, Bi in an amount of 0.2 wt % or less, Ta in an amount of 0.05 wt % or less, B in an amount of 0.01 wt % or less, and a rare earth metal element in an amount of 0.5 wt % or less.

33. The free-cutting tool steel according to claim 25 used as a source material for die for molding plastics.

* * * * *